US008256438B2

(12) United States Patent
Tojo et al.

(10) Patent No.: US 8,256,438 B2
(45) Date of Patent: Sep. 4, 2012

(54) HAIR HOLDER, OPEN/CLOSE DEVICE FOR HAIR-HOLDING MEMBER, AND HAIR HOLDER FOR HAIR TREATMENT

(75) Inventors: Takehiko Tojo, Tochigi (JP); Koji Saito, Tokyo (JP); Hideo Kobayashi, Tochigi (JP); Toshio Watanabe, Tokyo (JP); Haruomi Enomoto, Tokyo (JP)

(73) Assignee: Kao Corporation, Tokyo (JP)

( * ) Notice: Subject to any disclaimer, the term of this patent is extended or adjusted under 35 U.S.C. 154(b) by 635 days.

(21) Appl. No.: 12/281,538

(22) PCT Filed: Mar. 2, 2007

(86) PCT No.: PCT/JP2007/054030

§ 371 (c)(1),
(2), (4) Date: Nov. 6, 2008

(87) PCT Pub. No.: WO2007/100088

PCT Pub. Date: Sep. 7, 2007

(65) Prior Publication Data

US 2009/0056738 A1 Mar. 5, 2009

(30) Foreign Application Priority Data

Mar. 3, 2006 (JP) ..... 2006-058553
Mar. 3, 2006 (JP) ..... 2006-058764
Jan. 15, 2007 (JP) ..... 2007-006235

(51) Int. Cl.
*A45D 19/18* (2006.01)
*A45D 2/00* (2006.01)

(52) U.S. Cl. ..... 132/270; 132/222

(58) Field of Classification Search ..... 132/270, 132/212, 222, 207, 210, 277, 221
See application file for complete search history.

(56) References Cited

U.S. PATENT DOCUMENTS 1,991,147 A * 2/1935 Fulton ..... 132/222
3,363,293 A * 1/1968 Nemrod et al. ..... 24/30.5 P
3,692,032 A * 9/1972 Regas ..... 132/212
3,861,405 A * 1/1975 Pellecchia ..... 132/270
5,771,906 A 6/1998 De Benedictis (Continued)

FOREIGN PATENT DOCUMENTS

JP 57 90001 6/1982

(Continued)

OTHER PUBLICATIONS

Extended European Search Report issued Aug. 8, 2011, in Patent Application No. 07737678.8.

(Continued)

*Primary Examiner* — Robyn Doan
(74) *Attorney, Agent, or Firm* — Oblon, Spivak, McClelland, Maier & Neustadt, L.L.P.

(57) ABSTRACT

A hair holder includes a tube formed of a sheet in such a design as to allow a hair bundle to be inserted from a one-end opening at one end of the tube toward an other-end opening at the other end thereof. The tube includes an integration mechanism in the vicinity of the one-end opening. The integration mechanism is for a clip-type fixing member having a pair of pinchers. The one-end opening is openable and closable by operating the clip-type fixing member having been integrated with the tube.

4 Claims, 15 Drawing Sheets

U.S. PATENT DOCUMENTS

| | | | | |
|---|---|---|---|---|
| 2004/0031502 | A1 * | 2/2004 | Winckels et al. | 132/270 |
| 2004/0216759 | A1 | 11/2004 | Elmer et al. | |
| 2004/0231689 | A1 * | 11/2004 | Kobayashi et al. | 132/222 |

FOREIGN PATENT DOCUMENTS

| | | |
|---|---|---|
| JP | 57 99502 | 6/1982 |
| JP | 8 252111 | 10/1996 |
| JP | 9 40006 | 2/1997 |
| JP | 9 509348 | 9/1997 |
| JP | 2000-253922 | 9/2000 |
| JP | 2003-93133 | 4/2003 |
| JP | 2004-41723 | 2/2004 |
| JP | 2005 58583 | 3/2005 |

OTHER PUBLICATIONS

Office Action issued Nov. 2, 2010 in JP Application No. 2006-058764 (With English Translation).

European search report issued Dec. 5, 2011, in European Patent Application No. 07737678.8, 3 pages.

European search report issued Dec. 21, 2011, in European Patent Application No. 07737678.8, 4 pages.

* cited by examiner

HAIR HOLDER, OPEN/CLOSE DEVICE FOR HAIR-HOLDING MEMBER, AND HAIR HOLDER FOR HAIR TREATMENT

TECHNICAL FIELD

The present invention relates to a hair holder capable, for example, of dyeing or permanent-waving a prescribed amount of hair.

The present invention also relates to an open/close device for opening and closing a tubular hair-holding member that holds a hair bundle inserted therein and that is used in applying treatments to the hair, such as partial coloring and partial permanent-waving, and to a hair holder for hair treatment having the open/close device fixed to the hair-holding member.

BACKGROUND ART

Hair holders formed of a tube and capable of, for example, dyeing or permanent-waving a prescribed amount of hair are conventionally known. These types of hair holders are formed of a flexible tube and are so designed that a hair bundle is inserted into the tube from one end thereof. For example, in dyeing a hair bundle, a dyeing agent is supplied into the tube and is applied inside the tube to the hair bundle.

Using a material that is impermeable to dyeing agents as the material forming the tube prevents dyeing of hair other than the portion of hair inserted in the hair holder, and thus, partial hair dyeing is achieved effectively.

For example, Applicant proposes a hair holder in Patent Document 1 (see below) filed previously. The hair holder is formed of a tube made of a long narrow flexible material having a hair inlet at one end thereof, and includes roll-up means for curling or bending hair by rolling up the hair held by the tube into a prescribed shape.

Patent Document 2 discloses a hair holder formed of a tube designed so that a hair bundle can be inserted from an opening at one end toward the other end. The tube is made of a soft material. Patent Document 2 also discloses providing annular sealing means made of a spring structure on each end of the tube.

Patent Document 3 discloses a hair holder having a tube that is formed of a sheet and designed so that a hair bundle can be inserted from an opening at one end toward the other end. The tube contains a hair treating agent.

Patent Document 4 below discloses a hair roller in which hair is dyed by folding a transparent sheet such as a plastic film into two lengthwise, enclosing hair in the folded sheet, fixing the hair bundle with a hair clip that opens and closes at one end thereof and that is provided on the outer side at the upper end of one of the folded halves, and applying a hair dyeing agent to the enclosed hair bundle.

Patent Document 1: JP2003-93133 A
Patent Document 2: US2004/216759 A1
Patent Document 3: JP2004-41723 A
Patent Document 4: JP2000-253922 A

DISCLOSURE OF THE INVENTION

With the hair holder disclosed in Patent Document 1, operating the roll-up means with a portion of hair on the head being inserted in the tube causes the tube to deform together with the hair bundle inserted therein, thus fixing the hair holder to the hair bundle. However, merely fixing the hair holder to the hair bundle inside the tube may cause the tube to fall off from its initially-fixed position on the hair bundle during hair treatment operations. For example, the hair holder is prone to fall off in cases where the roll-up means does not sufficiently roll up the hair bundle.

The hair holder disclosed in Patent Document 2 is also prone to fall off from the hair bundle during hair treatment operations.

A conceivable way to fix the hair holder to the hair bundle is to first insert the hair bundle into the tube, then close the opening of the tube with a clip-type fixing member having a pair of pinchers, and thereby pinch the hair bundle with the opening. The clip-type fixing member is convenient in terms that it can fix the hair holder easily. The clip-type fixing member, however, does not have the function of opening up the opening of the tube.

The hair holder disclosed in Patent Document 3 can open and close both ends of the tube with the sealing means. The sealing means of Patent Document 3, however, increases the manufacturing cost of the tube as well as the hair holder.

Accordingly, a first aspect of the present invention relates to providing a hair holder that allows easy and quick hair-bundle insertion into a tube and fixing of the tube to a hair bundle.

The hair roller disclosed in Patent Document 4 not only holds the enclosed hair bundle when closing the mouth of the hair clip, but often takes in and grasps hair therearound. The hair roller thus has problems such as causing hair creases, pain to the user due to hair jerking, and poor operability. The above-described problems are particularly notable in cases where the user carries out the treatment himself/herself, causing significant deterioration in operability.

Accordingly, a second aspect of the present invention relates to providing a device for a hair holder and a hair holder for hair treatment capable of overcoming the drawbacks of the above-described conventional art.

Further, the hair holders disclosed in Patent Documents 1 to 3 above are so designed that, upon attachment to the head, the hair holder is merely fixed to the hair bundle inserted inside the tube. However, the hair holder is prone to slip on the hair bundle inserted inside the tube. Therefore, the hair holder may slip or fall off from the head during attachment or hair treatment. Further, when the hair holder is attached to the head, the portion of the scalp at the root of the hair bundle to be treated is burdened with the weight of the hair holder as well as the weights of the hair bundle itself and the hair treating agent. Thus, the user may feel that the portion of the scalp, which is at the root of the hair bundle to be treated, is being pulled downward.

Accordingly, a third aspect of the present invention relates to providing a hair holder achieving comfortable attachment and stable attachment to the head.

The first aspect of the present invention achieves some advantages by providing a hair holder including a tube, the tube being formed of a sheet in such a design as to allow a hair bundle to be inserted from a one-end opening at one end of the tube toward the other end thereof. The tube has, in the vicinity of the one-end opening, integration means which allows a clip-type fixing member having a pair of pinchers to be integrated with the tube. The one-end opening is openable and closable by operating the clip-type fixing member having been integrated with the tube (the above-described structure is referred to hereinbelow as the "first aspect of the invention").

Further, the first aspect of the present invention achieves some advantages by providing a hair holder including: a tube formed of a sheet in such a design as to allow a hair bundle to be inserted from a one-end opening at one end of the tube toward the other end thereof; and a clip-type fixing member having a pair of pinchers. The clip-type fixing member is integrated with the tube in the vicinity of the one-end opening. The one-end opening is openable and closable by operating the clip-type fixing member.

The second aspect of the present invention achieves some advantages by providing an open/close device for a cylindrical hair-holding member that holds a hair bundle inserted from a one-end opening at one end of the hair-holding member toward the other end thereof. The device opens and closes the opening of the hair-holding member. The device includes: an insert-and-attach opening whose inner circumference to which the one end of the hair-holding member is inserted and fixed forms a closed region; and expansion/contraction means for expanding and contracting the insert-and-attach opening.

Further, another aspect of the present invention provides a hair holder for hair treatment, wherein the open/close device for the hair-holding member according to the above-mentioned aspect of the invention is fixed to the one end of the hair-holding member.

The third aspect of the present invention achieves some advantages by providing a hair holder including: a tube formed of a sheet in such a design as to allow a hair bundle to be inserted from a one-end opening at one end of the tube toward an other-end opening at the other end thereof; and fixing means for fixing the tube to a hair bundle other than a hair bundle inserted from the one-end opening.

DETAILED DESCRIPTION OF THE INVENTION

The following describes the present invention according to preferred embodiments thereof.

Figure 1:
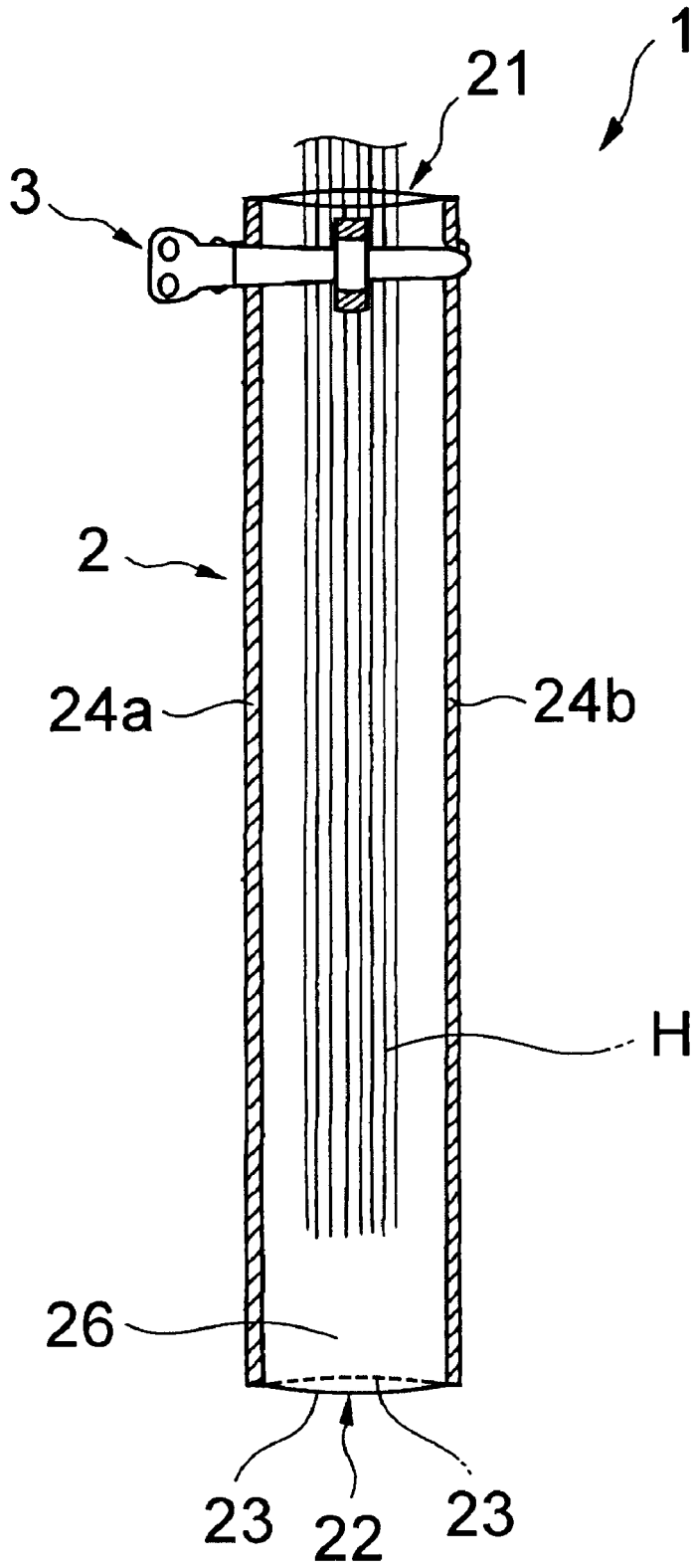
FIG. 1 is a perspective showing a first embodiment of a hair holder according to the present invention.
Figure 2A:
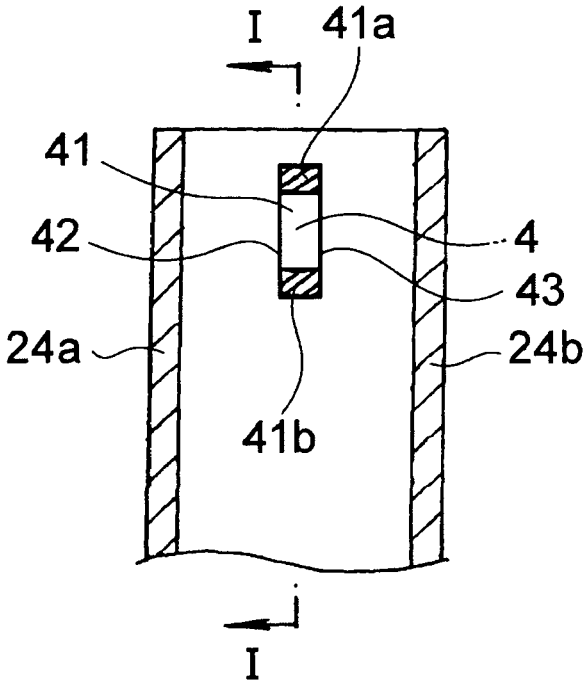
FIG. 2(*a*) and FIG. 2(*b*) are partially enlarged diagrams showing in enlargement the vicinity of an opening at one end of the hair holder of FIG. 1, wherein FIG. 2(*a*) is a front view thereof and FIG. 2(*b*) is a cross-sectional view taken along line II-II of FIG. 2(*a*).
Figure 2B:
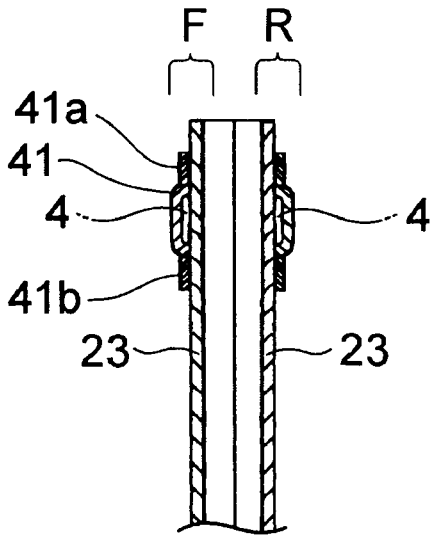
Figure 3:
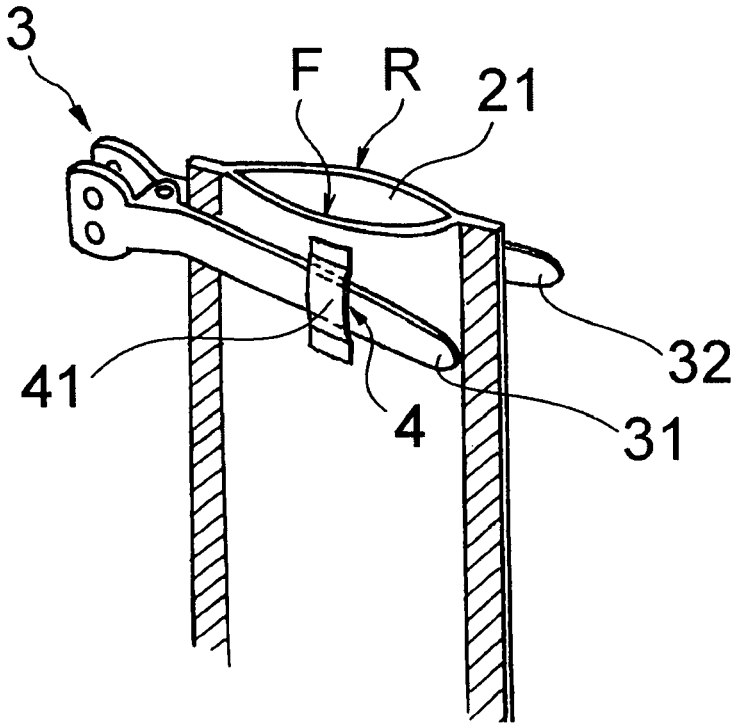
FIG. 3 is a perspective showing in enlargement the vicinity of the opening at one end of the hair holder of FIG. 1.

As shown in FIGS. 1 to 3, a hair holder 1 according to a first embodiment of the present invention (a first aspect of the invention) has a tube 2 and is used to dye a hair bundle H. The tube 2 is formed of sheets 23 and 23 and so designed that the hair bundle H can be inserted from an opening 21 at one end toward an opening 22 at the other end.

The tube 2 of the hair holder 1 has integration means in the vicinity of the one-end opening 21. The integration means allows a clip-type fixing member 3 having a pair of pinchers to be integrated with the tube. Operating the clip-type fixing member 3 having been integrated with the tube 2 allows the one-end opening 21 to open and close. "Integration" as referred to in the present invention includes instances where the component is removable after integration through prescribed operations.

The hair holder 1 of the first embodiment is described in detail below.

As shown in FIG. 1, the tube 2 is long in its longitudinal direction and is so structured that the hair bundle H can be inserted from the one-end opening 21 toward the other-end opening 22. The tube 2 is formed of a pair of rectangular sheets 23 and 23 that are long in their longitudinal directions. The pair of sheets 23 and 23 is made into the tube by joining their corresponding side ends together at the lengthwise side ends 24*a* and 24*b* of the tube 2. Each sheet, of the pair of sheets 23 and 23, is soft and thus the tube 2 is flexible.

The length of the tube 2 is set appropriately depending on the length of the hair to be treated, and is preferably longer than the length of the hair to be treated. Each opening 21, 22 of the tube 2 has a narrow elliptic shape in its natural state, and its size is set appropriately depending on the amount of the hair bundle to be inserted.

Generally, the tube 2 has a length of approximately 50 to 600 mm. As regards the size of the openings 21 and 22, a distance W from one side end 24*a* of the tube 2 to the other side end 24*b* thereof (see FIG. 4(*a*)) is approximately 5 to 10 mm; this distance W is measured in a state where one side F (the front side, or hereinafter the "first side F") and the opposing other side R (the rear side, or hereinafter the "second side R") of the tube 2 are arranged in close contact with or generally parallel to one another. The distance W is equal to half the circumferential length of the inner surface of each opening 21, 22. Further, the size of each opening 21, 22 in its opened state ranges approximately from 5 to 100 mm in major diameter and approximately from 2 to 40 mm in minor diameter. The openings 21 and 22 of the tube 2 are circular when the major diameter is equal to the minor diameter.

The pair of sheets 23 and 23 is made of a material impermeable to dyeing agents, and therefore, no dyeing agent leaks out from the surfaces of the tube 2. This prevents hair other than the hair bundle inserted in the hair holder 1 from being dyed. Accordingly, the dyeing treatment using the hair holder 1 of the present embodiment is suitable for partially dyeing the hair on one's head.

The dyeing agent exists in the hair holder 1 in a relatively sealed state. Therefore, in cases where the dyeing agent includes volatile components, such components are prevented from volatilizing during dyeing. Accordingly, the hair holder is advantageous in that the dyeing treatment can be performed efficiently.

In cases where the hair holder 1 is to be used for dyeing, resin films made of polyethylene etc. or laminates including such resin films and woven fabrics, webs, etc. may preferably be used as the materials for forming the pair 23 and 23.

The tube 2 of the hair holder 1 of the present embodiment has passages 4 and 4 through which the pair of pinchers 31 and 32 can respectively pass on the respective opposing first and second sides F and R of the tube 2. These passages serve as integration means allowing the clip-type fixing member 3 with the pair of pinchers 31 and 32 to be integrated with the tube.

The passages 4 and 4 according to the present embodiment are configured as follows: as shown in FIG. 2(*a*), a strip 41 is provided on the outer surface of each sheet 23 of the respective first and second sides F and R in such a state that both ends 41*a* and 41*b* of the strip is joined to the sheet 23; and a space between the sheet 23 and the central section of the strip 41 not joined to the sheet 23 allows the pincher 31 (or 32) of the clip-type fixing member 3 to pass therethrough.

Figure 4A:
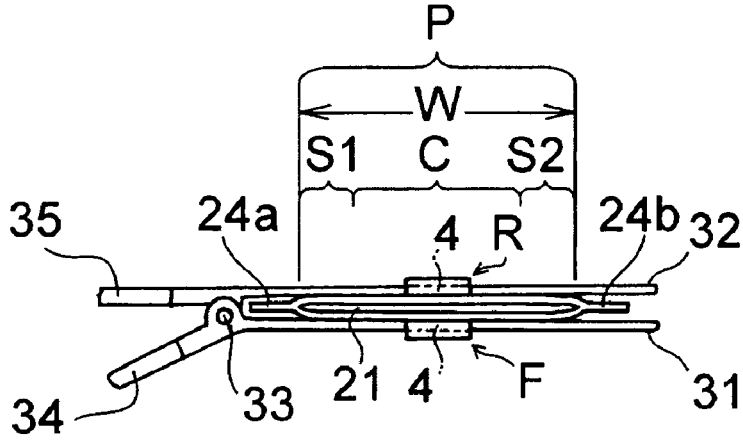
FIG. 4(*a*), FIG. 4(*b*) and FIG. 4(*c*) are diagrams showing a preferable position for providing integration means, wherein FIG. 4(*a*) is a schematic diagram showing the opening in its closed state, FIG. 4(*b*) is a schematic diagram showing the opening in its opened state, and FIG. 4(*c*) is a schematic diagram showing the opening in a slightly-opened state.
Figure 4B:
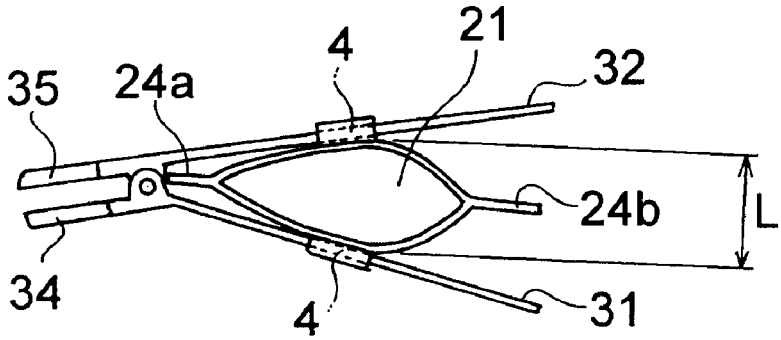
Figure 4C:
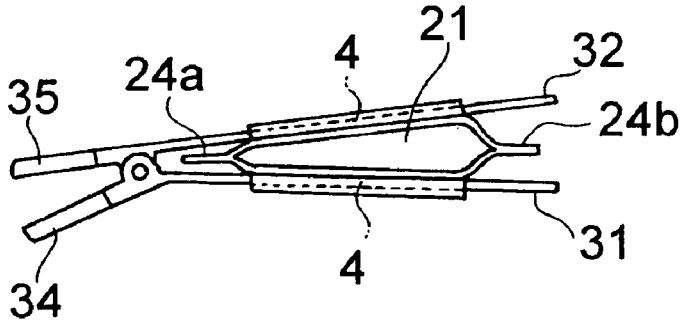

Accordingly, as shown in FIG. 3 or 4, the clip-type fixing member 3 is mounted onto the vicinity of the one-end opening of the tube 2 by passing the paired pinchers 31 (and 32) respectively through the paired passages 4 and 4. In this way, a portion of each of the paired pinchers 31 and 32 is integrated with a portion of the tube 2.

Operating the clip-type fixing member 3 having been integrated with the tube 2 allows the opening 21 of the tube 2 to open easily and quickly as shown in FIG. 4(*b*) and also the one-end opening 21 to close easily and quickly as shown in FIG. 4(*a*).

The clip-type fixing member 3 is so structured that one end of the pincher 31 is coupled to one end of the paired pincher 32, and the fixing member 3 allows fixing to the hair bundle by sandwiching the hair bundle between the pair of pinchers 31 and 32.

According to an aspect of the invention, the clip-type fixing member 3, which is preferably used together with or as a part of the hair holder, is so designed that the paired pinchers 31 and 32 are pivotally coupled about a pivot 33 as shown in FIG. 4 and a spring (not shown) provided on the pivot 33 urges the fixing member in a direction in which the paired pinchers 31 and 32 close up. The so-designed clip-type fixing member 3 allows opening/closing of the pair of pinchers 31 and 32—as well as opening/closing of the opening 21 of the tube 2 in conjunction with the opening/closing of the pinchers—through an easy operation, i.e., by gripping/releasing, with the hand, grips 34 and 35 formed continuously on the respective paired pinchers 31 and 32 at the above-mentioned one end thereof.

It is also possible to use a clip-type fixing member having no grip 34, 35. For example, it is possible to use a fixing member made of a pair of metal pinchers 31 and 32 each having spring-like elasticity and being placed upon one another and joined together at one end. With this fixing member, the paired pinchers 31 and 32 can be opened by being bent together in one direction and closed by being bent in the other direction.

The hair holder 1 according to the present embodiment allows the opening 21 to open easily through an extremely easy operation of the clip-type fixing member 3. Therefore, a hair bundle H can be inserted easily and quickly from the opening 21 into the tube 2 with, for example, a hair inserter described further below.

Further, closing the one-end opening 21 with the hair bundle H inserted in the tube 2 will result in the hair bundle H being sandwiched by the opening 21, thus allowing the tube 2 to be fixed to the hair bundle H easily and stably. Note that closing of the opening 21 only needs to allow this fixing of the tube to the hair bundle to be achieved, and does not necessarily have to make the opposing first and second sides F and R closely contact one another across the entire region between the side ends 24*a* and 24*b* of the tube 2.

In the hair holder 1 of the present embodiment, passing the pinchers 31 (and 32) through the passages 4 and 4 integrates each of the paired pinchers 31 and 32 with a section within an area between the one side end 24*a* and the other side end 24*b* of the tube 2 (i.e., within an area indicated by P in FIG. 4(*a*); this area is also referred to hereinbelow as the "in-between of the side ends 24*a* and 24*b*") but excluding a section S1 close to the one side end 24*a* and a section S2 close to the other side end 24*b*. That is, the pinchers 31 (and 32) of the clip-type fixing member 3 are integrated with a central region C within the in-between of the side ends 24*a* and 24*b* of the tube 2.

In cases where the pinchers 31 and 32 of the clip-type fixing member 3 are integrated with substantially the entire region of the in-between of the side ends 24*a* and 24*b* of the tube 2 as shown in FIG. 4(*c*), there are instances in which the opening 21 of the tube 2 cannot be opened widely by operating the clip-type fixing member 3, as shown in FIG. 4(*c*).

With the hair holder 1 of the present embodiment, on the other hand, each of the paired pinchers 31 and 32 is integrated with a section within the in-between of the side ends 24*a* and 24*b* of the tube 2 but excluding the section S2 close to the side end 24*b* located on the tip-end side of the pinchers of the clip-type fixing member 3. In this way, the opening 21 of the tube 2 can be opened widely as shown in FIG. 4(*b*), and thus the hair bundle can be inserted into the tube 2 more easily.

Further, in the present embodiment, each of the paired pinchers 31 and 32 is integrated with a section within the in-between of the side ends 24*a* and 24*b* of the tube 2 but excluding both the section S1 close to the one side end 24*a* and the section S2 close to the other side end 24*b*. In this way, the opening 21 of the tube 2 can be opened even more widely, and thus the hair bundle can be inserted into the tube 2 even more easily. Moreover, the same effects can be attained even if the passage for inserting one pincher 31 and the passage for inserting the other pincher 32 are used in reverse.

In the hair holder 1 according to the first aspect of the invention, as indicated by the results of a later-described example, it is preferable to integrate each paired pincher 31, 32 with a section occupying 80% or less, and more preferably to a section occupying 60% or less, of a distance between the one side end and the other side end of the tube, in terms of the magnitude of the opening amount and ease of hair insertion. In the hair holder 1 of the present embodiment, the width of each strip 41 (i.e., the dimension thereof in the direction in which the pincher is inserted) is preferably within the above-mentioned range.

Now, on the assumption that the distance W of the in-between of the side ends 24*a* and 24*b* is divided into ten equal regions, the section S1 close to the one side end 24*a* and the section S2 close to the other side end 24*b*, which are within the in-between of the side ends 24*a* and 24*b* of the tube 2, each occupy approximately two regions on the respective ends. As regards the strip 41 forming each passage 4 (integration means), the side edges 42 and 43 thereof respectively located fore and aft in the insertion direction of the pincher 31 (see FIG. 2(*a*)) preferably exist within the eight central regions—assuming that the in-between of the side ends 24*a* and 24*b* is divided into ten regions as mentioned above. Then, on the assumption that the distance W of the in-between of the side ends 24*a* and 24*b* of the tube is now divided into five equal regions, it is more preferable that the passage 4, which serves as the integration means of the first aspect of the invention, and a fixing section 4A in a second aspect of the invention each exist within the three central regions.

The hair holder 1 of the present embodiment allows the clip-type fixing member 3 to be detachably mounted to the tube 2 via the passages 4 and 4. Therefore, the hair holder can be used in such a manner that the tube 2 is discarded after one-time use but the clip-type fixing member 3 is used repeatedly. Materials similar to those of various conventionally-known hairclips can be used for forming the clip-type fixing member 3; preferable materials are those that do not cause chemical reactions, in particular, corrosion, discoloration, etc. to dyeing agents. Such materials preferably include, for example, resinous materials such as polypropylene, polyacetal, and polyethylene. Even materials that cause chemical reactions, such as corrosion and discoloration, to dyeing agents can preferably be used if their surfaces are covered, for example, with a metal or a resin chemically inert to dyeing agents.

As shown in FIG. 4(*a*), the passages 4 and 4 in the hair holder 1 of the present embodiment are formed at plane-symmetrical positions on the opposing first and second sides F and R of the tube 2. Thus, the passages 4 and 4 are formed on the respective first and second sides F and R at the same position with respect to the width direction of the tube (i.e., the left-to-right direction in FIG. 4(*a*)). However, the passage 4 of the first side F of the tube 2 and the passage 4 of the opposing second side R can be positioned differently with respect to the width direction of the tube 2.

Figure 5A:
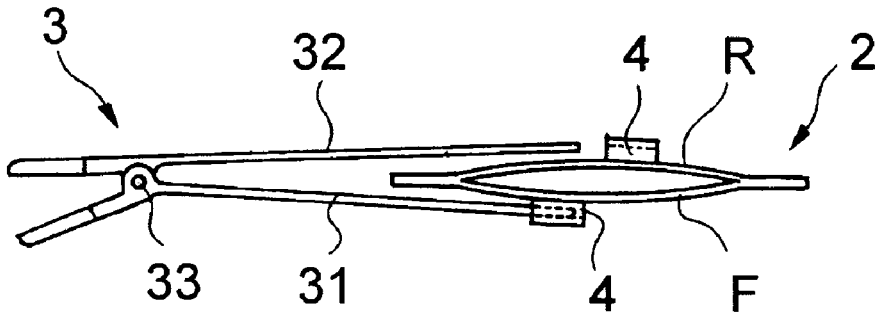
FIG. 5(*a*), FIG. 5(*b*) and FIG. 5(*c*) are schematic diagrams showing preferable modifications of the hair holder according to the first embodiment.
Figure 5B:
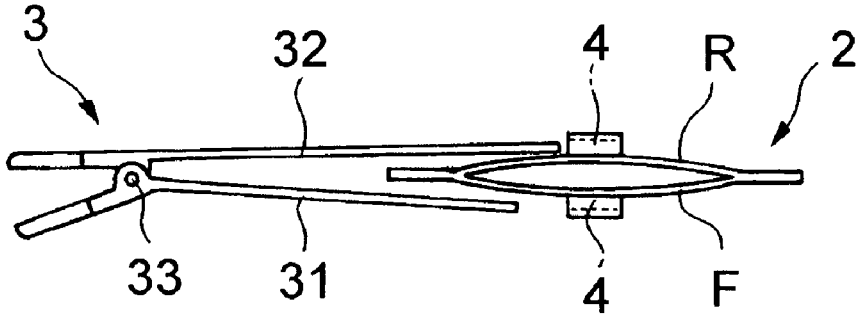
Figure 5C:
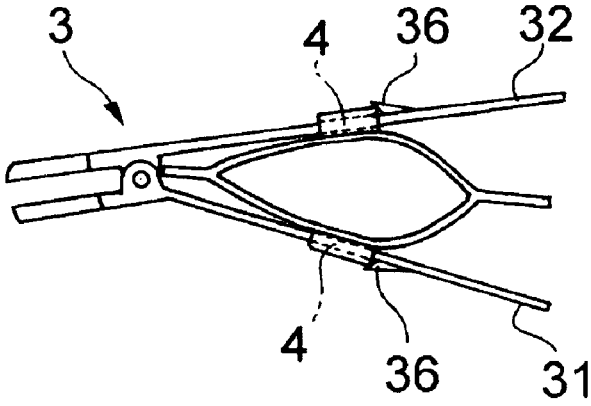

For example, the passage 4 of the first side F of the tube 2 and the passage 4 of the opposing second side R are positioned differently with respect to the width direction of the tube 2, as shown in FIG. 5(*a*). In this way, the pinchers 31 and 32 can easily pass through the respective passages 4 and 4 upon integration of the clip-type fixing member 3 to the tube 2, thus allowing easy and quick mounting of the clip-type fixing member 3 to the tube 2.

Further, as shown in FIG. 5(*b*), a clip-type fixing member 3 in which the length of one pincher 31 differs from the other pincher 32 may be used. Such a design also allows easy insertion of the pinchers 31 and 32 into the respective passages 4 and 4, thus allowing easy and quick mounting of the clip-type fixing member 3 to the tube 2.

Further, as shown in FIG. 5(*c*), it is also preferable to use a clip-type fixing member 3 having, on one of or both the pinchers 31 and 32, means 36 for preventing the pinchers 31 and 32 having passed through the passages 4 and 4 from falling out therefrom. The fall-out prevention means 36 shown in FIG. 5(*c*) are projections that engage with the openings 42 and 43 of the passages 4 and 4, and inhibit the pincher 31 from being pulled out from the passage 4. Providing such a fall-out prevention means allows both easy mounting to the tube 2 and fall-out resistance after mounting. Further, an adhesive or a mechanical hook-and-loop fastener may be provided, for example, on the clip-type fixing member 3, on the outer surface of the tube 2, or on the inner surface of the passage 4 as the fall-out prevention means, so that the clip-type fixing member 3 does not move with respect to the tube 2 to thereby prevent the clip-type fixing member 3 from falling out from the passages 4.

The hair holder 1 of the present embodiment is described in further detail. In order to prevent dyeing agents supplied inside the tube 2 from flowing out from the other-end opening 22, a lower end 26 of the tube 2 preferably has an openable/closable sealing means.

The sealing means may be a zipper, for example. Providing a zipper on the lower end 26 allows opening/closing of the other-end opening 22. Other than a zipper, it is also possible to use, for example, a mechanical hook-and-loop fastener, an adhesive tape, or a self-adhesive tape (for example, "Fushigi Tape" (trade name) available from Nirei Industry Co., Ltd.) as the sealing means.

Further, the sealing means may preferably be achieved by joining, to the lower end 26, a member that has plasticity and can maintain its folded state, such as an aluminum foil. For example, a long rectangular aluminum foil strip having the same width as the tube 2 is joined thereto in such a manner that the edge of the foil strip is aligned with the edge of the tube on the side of the lower end 26. The section of the lower end 26 having the aluminum foil strip joined thereto is folded upward once or several times to thereby seal the lower end of the tube 2.

From the viewpoint of reliably fixing the fixing member to a hair bundle and preventing dyeing agents etc. from leaking from the opening 21, the length of each paired pincher 31 or 32 of the clip-type fixing member 3 used in combination with the tube 2 is preferably 90% or more, and more preferably 90 to 150%, of the distance W of the in-between of the side ends 24*a* and 24*b* of the tube 2.

Further, as regards the position of the integration means with respect to the length direction of the tube 2, the distance from the edge of the one-end opening 21 is preferably within a range of up to 20 mm, and more preferably within a range of up to 10 mm.

In the hair holder 1 of the present embodiment, it is also preferable to use a hair inserter upon dyeing treatment for inserting a hair bundle H from the one-end opening 21 into the tube 2. A preferable hair inserter has a latch-hook at one end in the length direction thereof for hooking a hair bundle H and a grip at the other end, and is inserted into the tube in advance or upon use, so that when in use, the latch-hook extends outward from the tube's one-end opening and the grip extends outward from the tube's other-end opening. The specifications etc. of JP2003-93133 A and US2004/216759 A1 mentioned above disclose examples of such a hair inserter.

The following describes an example of dyeing treatment using the above-described hair holder 1 and the preferable hair inserter. In terms of dyeing the entire hair bundle H, it is preferable that the length of the tube 2 of the hair holder 1 used for dyeing is longer than the length of the hair bundle H.

The hair holder 1 is prepared with the latch-hook of the hair inserter extending outward from the one-end opening 21 and the grip extending outward from the other-end opening 22. Passing the pair of pinchers 31 and 32 through the respective passages 4 and 4 of the tube 2 mounts the clip-type fixing member 3 onto the vicinity of the one-end opening 21 of the hair holder 1.

The hair bundle H is then hooked into the hair inserter's latch-hook. In doing so, it is preferable to hook, into the latch-hook, a portion of the hair bundle H close to the scalp. Then, the pair of pinchers 31 and 32 of the clip-type fixing member 3 is opened so as to open the opening 21 of the tube 2. In this state, the grip is pulled with the latch-hook engaged to the hair bundle H to insert the hair bundle H into the tube 2. The hair bundle H is brought into a generally linear, straightened state inside the tube 2.

After confirming that the opening 21 of the tube 2 is in an appropriate position on the hair bundle H, the pair of pinchers 31 and 32 of the clip-type fixing member 3 is closed so as to close the opening 21 of the tube 2 and fix the tube to the hair bundle H.

Then, a dyeing agent is supplied from the other-end opening 22 of the tube 2 and is spread and applied onto the hair bundle H by stroking the tube 2 with the fingers in a direction from the lower end 26 toward an upper end 25. Also, the lower end 26 is sealed in cases where the tube 2 has the above-described sealing means.

After repeating the same operation using a plurality of hair holders if desired, the hair holders and the hair held by the holders are left as they are for a prescribed amount of time.

After the prescribed time, the clip-type fixing member 3 is either removed from the tube 2 or operated to open the opening of the tube 2. In this state, the hair bundle H is removed from the hair holder 1. The hair is then rinsed, and if desired, is also shampooed and blow-dried.

Next, a hair holder 1A according to a second embodiment of the present invention (a second aspect of the invention) is described with reference to FIG. 6. The following mainly describes the differences between the first and second embodiments, and features in common are accompanied with the same symbols and are omitted from explanation. Features not particularly explained (including preferable configurations) are the same as those in the first embodiment, and the explanation given in the first embodiment applies to such features as appropriate.

Figure 6:
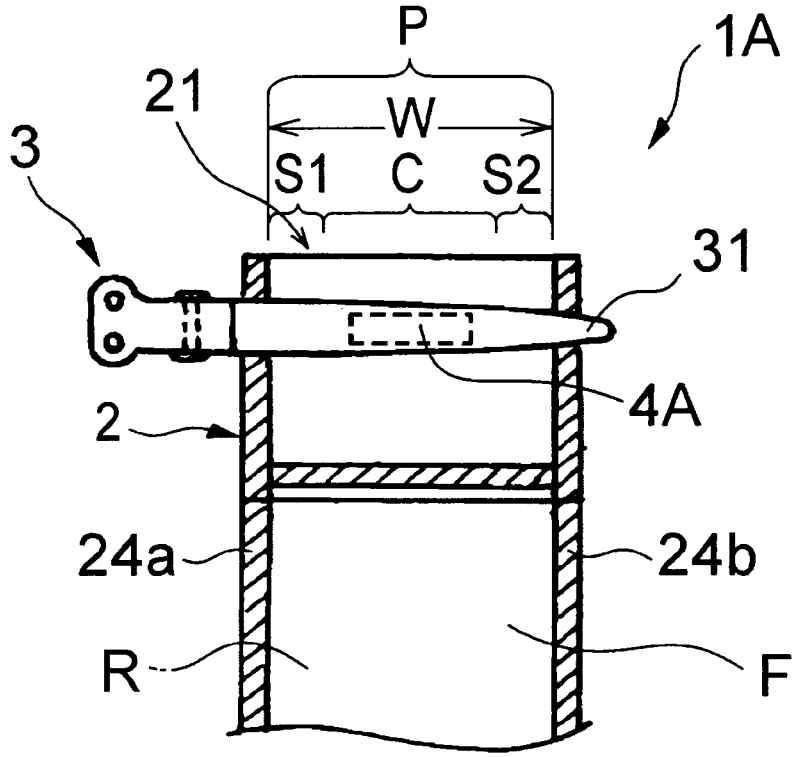
FIG. 6 is a front view showing primary sections of a second embodiment of a hair holder according to the present invention.

As shown in FIG. 6, in the hair holder 1A of the second embodiment, a clip-type fixing member 3 is joined to and integrated with the outer surface of a tube 2 in the vicinity of an opening 21 at one end of the tube 2. Examples of ways of achieving this joining include ultrasonic sealing, impulse sealing, heat sealing, adhesives, and double-faced adhesive tapes.

The hair holder 1A has a fixing section 4A on each of the opposing first and second sides F and R of the tube 2. A pincher 31 of the clip-type fixing member 3 is fixed to each fixing section 4A. On either side, the fixing section 4A is provided in a central region C within an in-between P of the side ends 24*a* and 24*b* of the tube 2, excluding both a section S1 close to the side end 24*a* located on the side of a pivot 33 of the clip-type fixing member 3 and a section S2 close to the side end 24*b* located on the side of the pinchers' tip ends of the clip-type fixing member 3. Note that the fixing sections 4A are formed at plane-symmetrical positions on the opposing first and second sides F and R of the tube 2.

With the hair holder 1A of the second embodiment as well, a simple open/close operation of the clip-type fixing member 3 allows easy opening/closing of the opening 21. Thus, as with the first embodiment, it is possible to achieve easy and quick hair-bundle insertion into the one-end opening 21 of the tube 2 and fixing of the hair holder to the hair bundle. Further, the fixing section 4A is provided in a section excluding the section S2 within the in-between of the side ends 24*a* and 24*b* of the tube 2, and particularly in the central region C. This allows the opening 21 to open more widely, thus achieving easier hair-bundle insertion.

The hair holder according to the present invention (the first and second aspects of the invention) is not limited to the above-described embodiments, and can be modified as appropriate as long as it does not depart from the spirit and scope thereof.

For example, the hair holder of the first aspect of the invention may have only the hair holder itself or may include both the hair holder and the clip-type fixing member.

Further, the integration means in the first aspect of the invention may be achieved by providing a hook member or a loop member of a mechanical hook-and-loop fastener on the outer surface of the tube 2 and providing a loop member and a hook member of the mechanical hook-and-loop fastener on the pinchers of the clip-type fixing member 3. The integration means in the first aspect of the invention may also be achieved by providing an adhesive or a double-faced adhesive tape on the outer surface of the tube 2, covering it with a release paper etc., and removing the release paper upon use to expose the adhesive face or the adhesive.

Further, the integration means in the first aspect of the invention and the fixing section in the second aspect of the invention do not have to be integrated with or fixed to only the section S2 close to the side end 24*b*, which is located on the pinchers' tip-end side of the clip-type fixing member 3, within the in-between of the tube's side ends 24*a* and 24*b*. That is, the section S1 close to the side end 24*a* located on the side of the pivot 33 of the clip-type fixing member 3 may be integrated with or fixed to the pincher.

Figure 7:
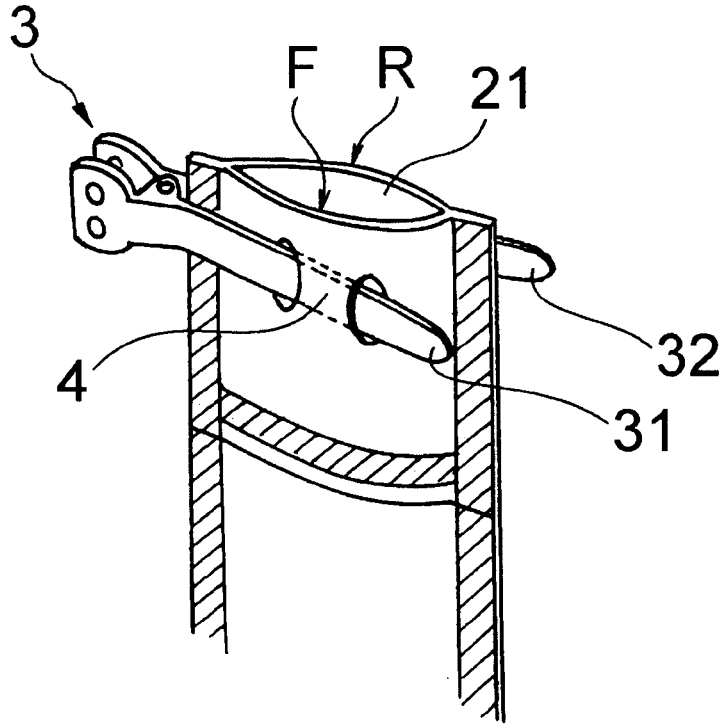
FIG. 7 is a perspective (corresponding to FIG. 3) showing primary sections of another embodiment according to a first aspect of the invention.

The passage 4 serving as the integration means of the first aspect of the invention does not have to be formed by fixing the strip 41 to the sheet 23 forming the tube. Instead, as shown in FIG. 7, each sheet 23 forming the tube may have a pair of holes 42 and 43, and an area between the holes 42 and 43 may serve as the passage 4 through which the pincher 31 or 32 can pass. In this case, attaching a member having high frictional resistance, such as a nonwoven fabric, on the tube's inner surface around the passage holes will allow the pincher having passed through the passage holes to be prevented from falling out from the passage.

Further, instead of forming the passage 4 by fixing the strip to the tube's outer surface, the passage may be formed by fixing, for example, a sheet material having any shape such as a square. It is also possible to prepare an originally-cylindrical component and fix it on the tube 2 with the axial direction of the component along the width direction of the tube.

Moreover, instead of integrating both pinchers 31 and 32 of the clip-type fixing member 3 at the above-described preferable positions within the in-between of the tube's side ends 24*a* and 24*b*, the hair holder may be structured so that only one of the pinchers is integrated at the above-described preferable position. The same applies to the fixing section 4A of the second aspect of the invention.

Permanent straightening is also preferably carried out using the hair holder of the present invention. For example, in performing the permanent-straightening treatment, it is necessary to apply a permanent treatment solution to the hair as the hair treating agent. In this case, it is preferable to use a material permeable to the permanent treatment solution as one or both of the pair of sheets 23 and 23 forming the tube 2. A hair bundle H to be subjected to the permanent treatment is held in the hair holder 1, and the permanent treatment solution is supplied from the outside of the hair holder 1 and applied to the hair bundle by permeating the sheet(s). This allows the permanent treatment to be done efficiently.

The features of a foregoing embodiment omitted from explanation and elements provided only in one embodiment are applicable to the other embodiments as appropriate, and the elements in each embodiment are interchangeable among the embodiments as appropriate.

Next, a hair holder for hair treatment (also referred to simply as "hair holder" hereinbelow) according to the present invention (a third aspect of the invention) is described based on its preferable embodiments with reference to the drawings.

Figure 8:
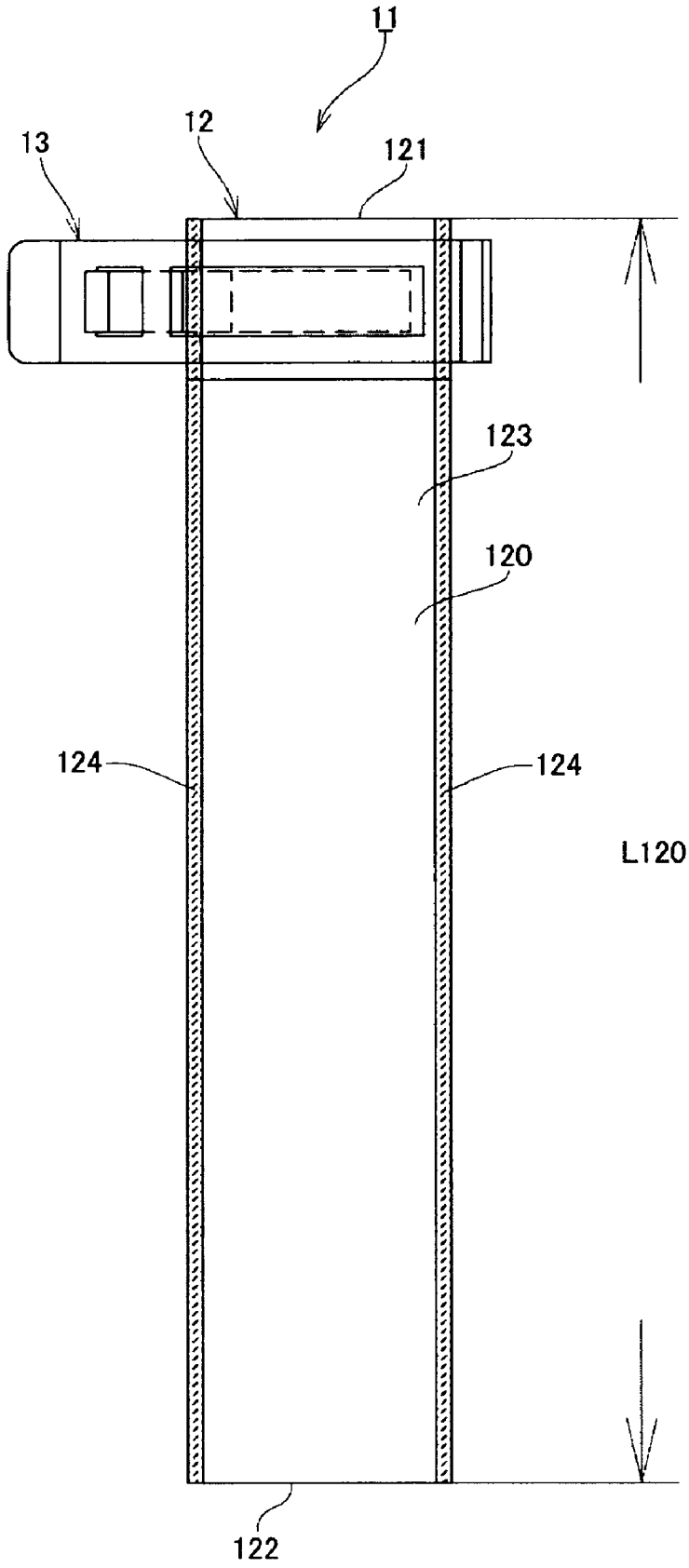
FIG. 8 is a front view showing a third embodiment of a hair holder for hair treatment according to the present invention.

FIG. 8 is a schematic diagram showing a third embodiment of a hair holder according to the present invention.

As shown in FIG. 8, a hair holder 11 of the present embodiment is formed of: a cylindrical hair-holding member 12 into which a hair bundle is inserted from an opening at one end toward the other end and that holds the hair bundle; and an open/close device 13 for the hair-holding member (also referred to simply as "open/close device" hereinbelow) that opens and closes the one-end opening of the hair-holding member 12. The one end of the hair-holding member 12 is inserted into a later-described insert-and-attach opening 131 of the open/close device 13, and the hair holder 11 is fixed to the inner circumference of the insert-and-attach opening 131. There is no particular limitation on how to fix the hair holder; however, taking repeated use of the open/close device 13 into consideration, it is preferable to fix the hair holder with, for example, adhesive tapes having adhesives provided on the inner surfaces of the insert-and-attach opening. The entire circumference of the one end of the hair-holding member 12, or only a part of the circumference, may be fixed, depending on the shape of the insert-and-attach opening 131.

The hair-holding member 12 is mainly formed of a tube 120, and has an insertion orifice 121 for insertion of a hair bundle and a supply orifice 122 for supplying a dyeing agent. In the present embodiment, the one-end opening constitutes the insertion orifice 121 and the other-end opening constitutes the dyeing-agent supply orifice 122. The tube 120 is formed by joining a pair of rectangular sheets 123 and 123 at their sides 124 and 124.

The length of the tube 120 is set appropriately depending on the length of the hair to be treated, and is preferably set longer than the length of the hair to be treated. Each opening of the tube 120 has an elliptic or circular shape and its size is set appropriately depending on the amount of the hair bundle to be inserted. The tube 120 has a length L120 of 50 to 600 mm. The size of each opening (the insertion orifice 121 and the supply orifice 122) ranges approximately from 5 to 100 mm in major diameter and approximately from 2 to 40 mm in minor diameter. The openings of the tube 120 are circular when the major diameter is equal to the minor diameter.

The sheet 123 is made of a material impermeable to dyeing agents, and therefore, no dyeing agent leaks out from the circumferential surface of the tube 120. This prevents hair other than the hair bundle inserted in the hair-holding member 12 from being dyed. Accordingly, the dyeing treatment using the hair-holding member 12 of the present embodiment is particularly effective in partially dyeing the hair on one's head. Further, the dyeing agent exists in the hair-holding member 12 in a relatively sealed state. Therefore, in cases where the dyeing agent includes volatile components, such components are prevented from volatilizing during dyeing. Accordingly, the hair-holding member is advantageous in that the dyeing treatment can be performed efficiently and that negative effects, such as smarting of the eyes from the volatile components, can be prevented.

Examples of materials preferably used for forming the sheet 123 include: films manufactured using a single type of synthetic resin, e.g., a polyolefin such as polyethylene and polypropylene, polyester such as polyethylene terephthalate, nylon, polystyrene, and polyvinyl chloride; films manufactured using blends of the above-mentioned synthetic resins; and synthetic-resin films obtained by laminating multiple layers of the above-mentioned films.

Figure 9A:
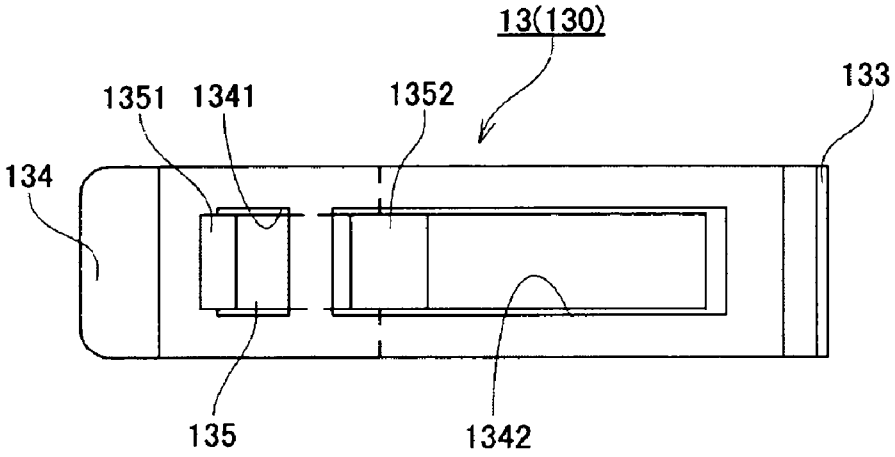
FIG. 9 (*a*) and FIG. 9(*b*) are diagrams showing a structure of an open/close device in the hair holder according to the third embodiment, wherein FIG. 9(*a*) is a front view thereof and FIG. 9(*b*) is a plan view thereof.
Figure 9B:
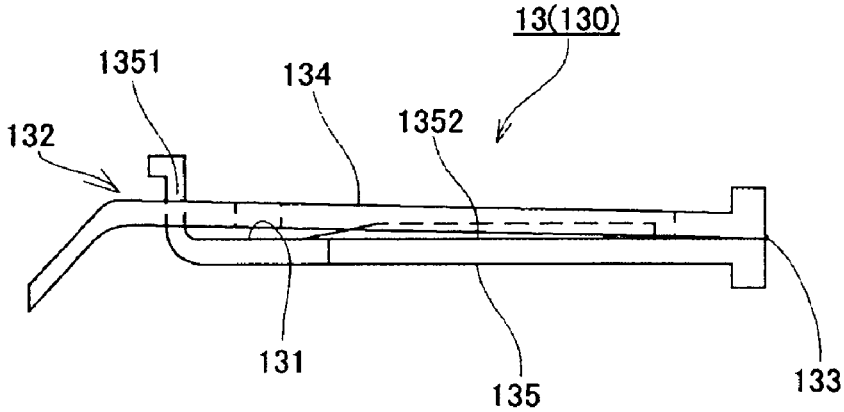

As shown in FIG. 9, the open/close device 13 has an insert-and-attach opening 131 whose inner circumference forms a closed region and to which the one end of the hair-holding member 12 is inserted and fixed, and expansion/contraction means 132 for expanding and contracting the insert-and-attach opening 131.

The open/close device 13 of the present embodiment is a hinge member 130 that is formed of a long piece 134 and a short piece 135 and that is bendable about a thin hinge section 133. The hinge member 130 is an integrally-molded component (a single component) made of synthetic resin. Examples of materials preferable for the hinge member 130 include synthetic resins such as polyethylene resins, polypropylene resins, nylon resins, and polybutylene terephthalate resins.

The long piece 134 has a guide hole 1341 rectangular in shape when observed from above in the vicinity of its tip end. The long piece 134 also has a slit 1342 adjacent the guide hole 1341 and extending in the length direction of the long piece. When the long piece 134 is in its straight, elongated state as described below, a later-described projection 1352 of the short piece 135 fits into the slit, thus increasing the friction between the hair holder and the hair and allowing the hair holder to be prevented from slipping or falling off from the hair bundle.

The tip end of the short piece 135 is formed into an engaging section 1351 bent in a direction that the hinge section 133 closes. The engaging section 1351 is inserted into and engages with the guide hole 1341 of the long piece 134. The short piece 135 has the above-mentioned projection 1352 that fits into the slit 1342 when the long piece 134 is in its straight, elongated state.

In this open/close device 13, the insert-and-attach opening 131 is formed by folding the hinge member 130 at the hinge section 133 and inserting the engaging section 1351 into the guide hole 1341 for engagement therewith. The inner circumference of the insert-and-attach opening 131 is formed of the inner surfaces of the long piece 134, the short piece 135, and the hinge section 133, and thus forms a closed region, as shown in FIG. 10.

Figure 10:
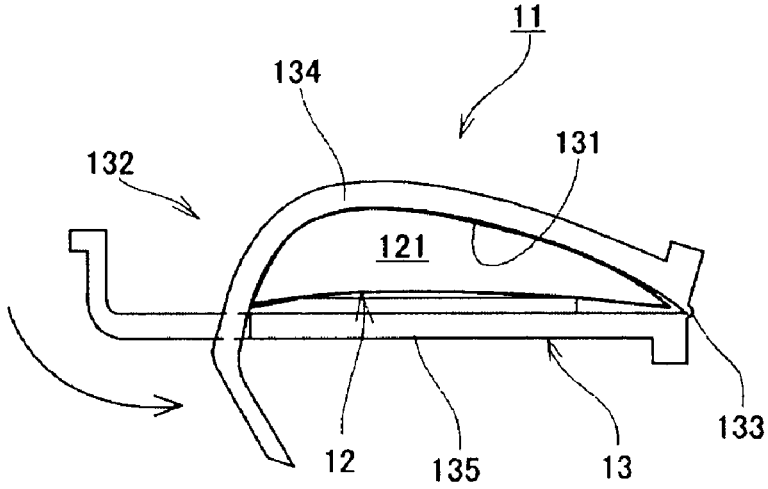
FIG. 10 is a diagram showing how an insertion orifice of a hair-holding member is widened by the open/close device in the hair holder according to the third embodiment.

As shown in FIG. 10, the expansion/contraction means 132 of the open/close device 13 is provided so as to expand or contract the insert-and-attach opening 131 through elastic deformation of the long piece 134 by applying a pressing force to the long piece 134 in such a manner as to press the long piece down toward the hinge section 133 or releasing the pressing force.

In the hair holder 11 of the present embodiment, when inserting the hair bundle, the insert-and-attach opening 131 is brought into its widened state by elastically deforming the long piece 134, as shown in FIG. 10. In conjunction therewith, the hair insertion orifice 121 of the hair holder 12 is also brought into its widened state, thus allowing easy insertion of the hair bundle. After inserting the hair bundle into the insertion orifice 121 up to the hairline in this widened state, the elastic deformation of the long piece 134 is released as shown in FIG. 9, to thus narrow the insert-and-attach opening 131 and hold the hair bundle with the hair holder. Then, the hair treating agent is supplied into the hair-holding member 12 and is spread onto the hair bundle by stroking the hair-holding member 12, thereby applying a desired treatment to the hair bundle.

As described above, the insert-and-attach opening 131 is expanded or contracted (i.e., the insertion orifice 121 is opened or closed) by elastically deforming the long piece 134, or releasing the elastic deformation, with the expansion/contraction means 132. Note here that the term "expansion" as used in "expansion/contraction" in this embodiment refers to a state in which the long piece 134 is elastically deformed (as in FIG. 10) and the term "contraction" as used in "expansion/contraction" refers to a state in which the elastic deformation of the long piece 134 is released (as in FIG. 9).

As described above, in the hair holder 11 of the present embodiment, the insert-and-attach opening 131 of the open/close device 13 forms a closed region when the hair bundle is inserted into the insertion orifice 121. Therefore, the open/close device hardly takes in nor grasps hair therearound, thus preventing hair creases and user pain due to hair jerking. Further, superior operability is achieved because expansion/contraction of the insert-and-attach opening 131 (opening/closing of the insertion orifice 121) is done easily by elastic deformation of the long piece 134.

Next, a fourth embodiment of a hair holder according to the present invention (the third aspect of the invention) is described. Note that the following describes an open/close device which characterizes the hair holder of the fourth embodiment, and features in common with the hair holder of the third embodiment are omitted from explanation. Therefore, the explanation given in the third embodiment applies as appropriate to such features not particularly explained.

Figure 11A:
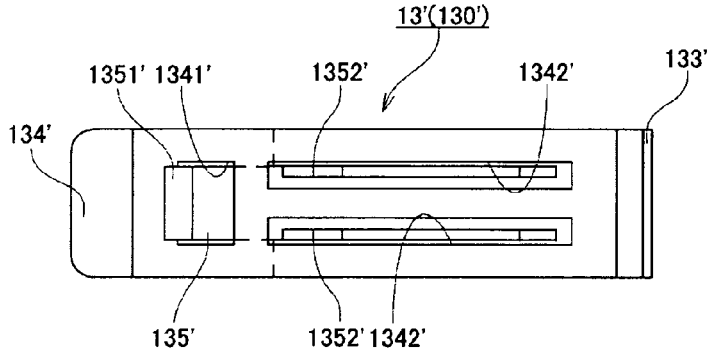
FIG. 11(*a*) and FIG. 11(*b*) are diagrams showing a structure of an open/close device in a hair holder according to a fourth embodiment of the present invention, wherein FIG. 11(*a*) is a front view thereof and FIG. 11(*b*) is a plan view thereof.
Figure 11B:
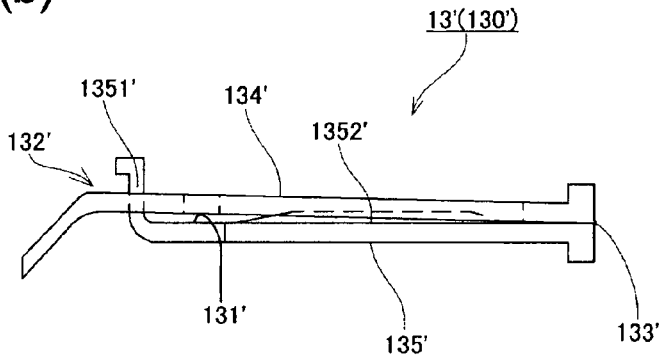

As shown in FIG. 11, the open/close device 13' in the hair holder of the fourth embodiment is similar in structure to the open/close device 13 of the third embodiment, except that the shapes of the long and short pieces are different from those of the open/close device of the third embodiment. More specifically, the open/close device 13' of the fourth embodiment has two slits 1342' provided side by side in a long piece 134' and wall-like projections 1352' on a short piece 135' to be inserted respectively into the slits 1342'; other than this, the structure of the device 13' is the same as the open/close device 13 of the third embodiment. With the open/close device 13' of the present embodiment as well, a hair bundle is first inserted from an insertion orifice of the hair holder up to the hairline, and then, when elastic deformation of the long piece 134' is released, the insertion orifice narrows so that the hair bundle is held by the hair holder. In addition to achieving the same effects as those of the open/close device 13 in the hair holder of the third embodiment, the open/close device 13' of the present embodiment surely prevents slipping and falling of the hair holder from the hair bundle, because the two side-by-side slits 1342' and projections 1352' inserted into the respective slits 1342' increase the contact area—and thus the frictional force—between the hair and the hair-holding member.

Next, a fifth embodiment of a hair holder according to the present invention (the third aspect of the invention) is described. Note that the following describes an open/close device which characterizes the hair holder of the fifth embodiment, and features in common with the hair holder of the third embodiment are omitted from explanation. Therefore, the explanation given in the third embodiment applies as appropriate to such features not particularly explained.

Figure 12A:
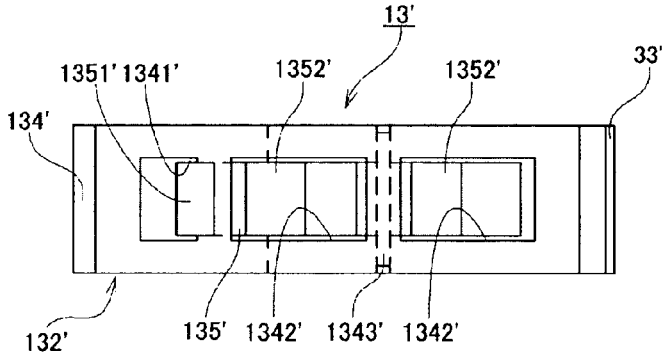
FIG. 12(*a*), and FIG. 12(*b*) are diagrams showing a structure of an open/close device in a hair holder according to a fifth embodiment of the present invention, wherein FIG. 12(*a*) is a front view thereof and FIG. 12(*b*) is a plan view thereof.
Figure 12B:
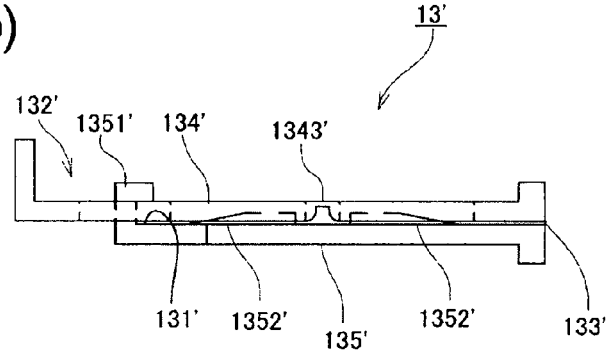

As shown in FIG. 12, the open/close device 13' in the hair holder of the fifth embodiment is so designed that bending and straightening of a long piece 134' causes expansion/contraction means 132' for an insert-and-attach opening 13' to expand and contract the insert-and-attach opening 131' (open and close the insertion orifice 121).

The long piece 134' has a thin hinge section 1343' in its central section with respect to the length direction, and bending/straightening the long piece 134' at the hinge section 1343' causes the insert-and-attach opening 131' to expand/contract. Since the long piece 134' is configured in this way, two slits 1342' are provided, one on each side of the hinge section 1343'.

A short piece 135' also has two projections 1352' at positions corresponding to the slits 1342'. The tip end of an engaging section 1351' is bent toward the hinge section 133, thus further enhancing the stability when the insert-and-attach opening 131' is closed.

Note here that the term "expansion" as used in "expansion/contraction" in this embodiment refers to a state in which the long piece 134' is bent (as in FIG. 13) and the term "contraction" as used in "expansion/contraction" refers to a state in which the long piece 134' is straightened out (as in FIG. 12).

Figure 13:
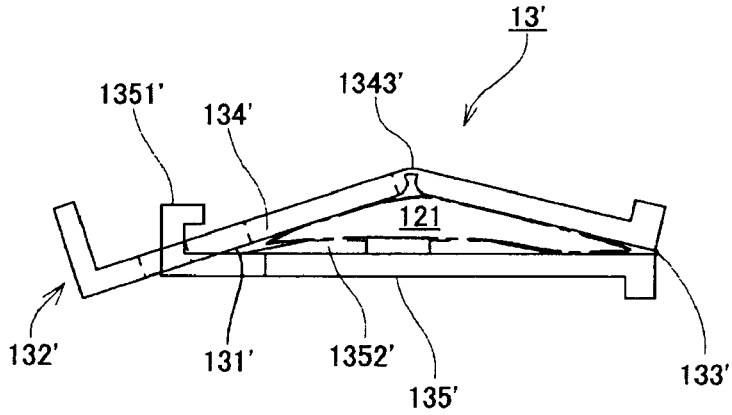
FIG. 13 is a diagram showing how an insertion orifice of a hair-holding member is widened by the open/close device in the hair holder according to the fifth embodiment.

As shown in FIG. 13, also in the hair holder of the present embodiment, the insert-and-attach opening 131' of the open/close device 13' forms a closed region when the hair bundle is inserted into the insertion orifice 121, as with the hair holder 11 of the fifth embodiment. Therefore, the open/close device hardly takes in nor grasps hair therearound, thus preventing hair creases and user pain due to hair jerking. Further, superior operability is achieved because expansion/contraction of the insert-and-attach opening 131' (opening/closing of the insertion orifice 121) is also done easily by bending/straightening of the long piece 134'.

Next, a sixth embodiment of a hair holder according to the present invention is described. The following describes an open/close device which characterizes the hair holder of the sixth embodiment, and features in common with the hair holder of the third embodiment are omitted from explanation. Therefore, the explanation given in the third embodiment applies as appropriate to such features not particularly explained.

Figure 14A:
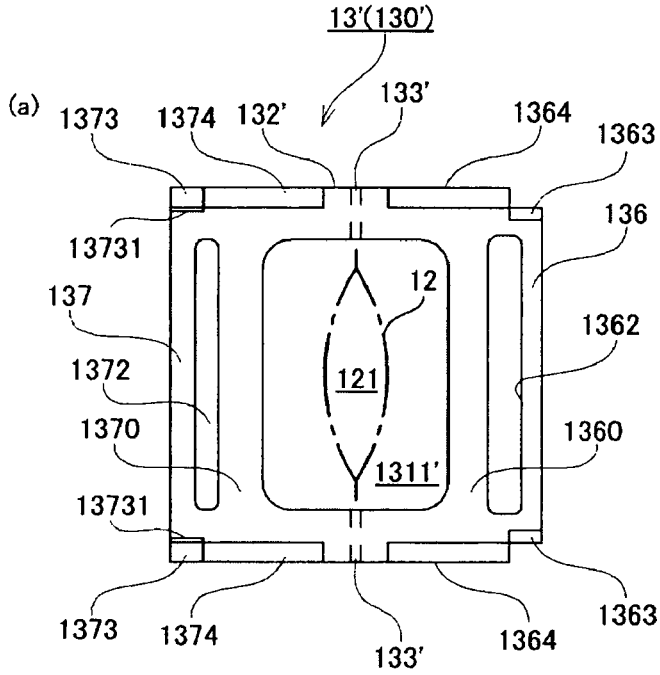
FIG. 14(*a*) and FIG. 14(*b*) are diagrams showing a structure of an open/close device in a hair holder according to a sixth embodiment of the present invention, wherein FIG. 14(*a*) is a plan view thereof and FIG. 14(*b*) is a side view thereof.
Figure 14B:
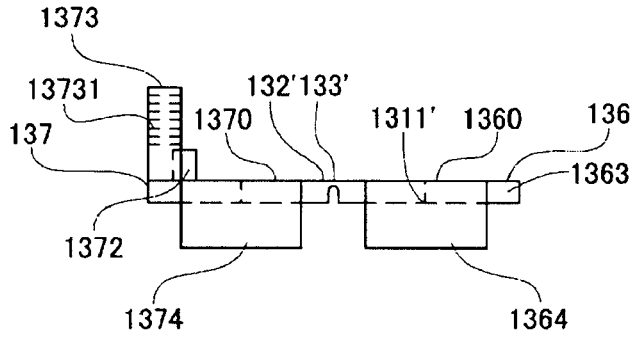

FIG. 14 shows an open/close device 13' in the hair holder of the sixth embodiment with the hinge sections 133', which is normally bent, in their extended, straightened-out state. As shown in FIG. 14, the open/close device 13' in the hair holder of the sixth embodiment is formed of a hinge member 130' that has a pair of halves 136 and 137 and that is bendable about the hinge sections 133'. The open/close device 13' has an opening 1311' in the central section of the hinge member 130'. The hinge sections 133' are formed on both sides of the opening 1311'. The hair holder 11' is used with the open/close device 13' fixed to a hair-holding member 12, this fixing being achieved by: inserting one end of the hair-holding member 12 on the side of the insertion orifice 121 through the opening 1311'; bending the hinge sections 133'; and joining the one end of the hair-holding member 12 to a flat face 1360 of the half 136, 137 and a flat face 1370 of the half 137.

The side faces 1363 at the tip end of the half 136 are slanted and have wedge-shaped cross sections. The flat face 1360 of the half 136 has a slit 1362 extending in the width direction of the half 136. The half 136 has, on both sides thereof, respective operation pieces 1364 that stand up perpendicularly from the flat face 1360 of the half 136. The operation pieces allow easy opening/closing operations of the halves 136 and 137 about the hinge sections 133'.

The half 137 has columns 1373 on both sides at the tip end thereof. The columns each have projections-and-depressions 13731 for engagement with the respective side faces 1363 of the half 136. Further, the flat face of the half 137 has a projection 1372 extending in the width direction of the half 137 and corresponding to the slit 1362. The projection 1372 fits into the slit 1362 when the open/close device 13' is bent at the hinge sections 133' and the halves 136 and 137 engage with one another. In this way, the friction between the hair holder and the hair is increased, and the hair holder can thus be prevented from slipping or falling off from the hair bundle. As with the half 136, the half 137 has, on both sides thereof, respective operation pieces 1374 that stand up perpendicularly from the flat face 1370 of the half 137. The operation pieces allow easy opening/closing operations of the halves 136 and 137 about the hinge sections 133'.

Figure 15:
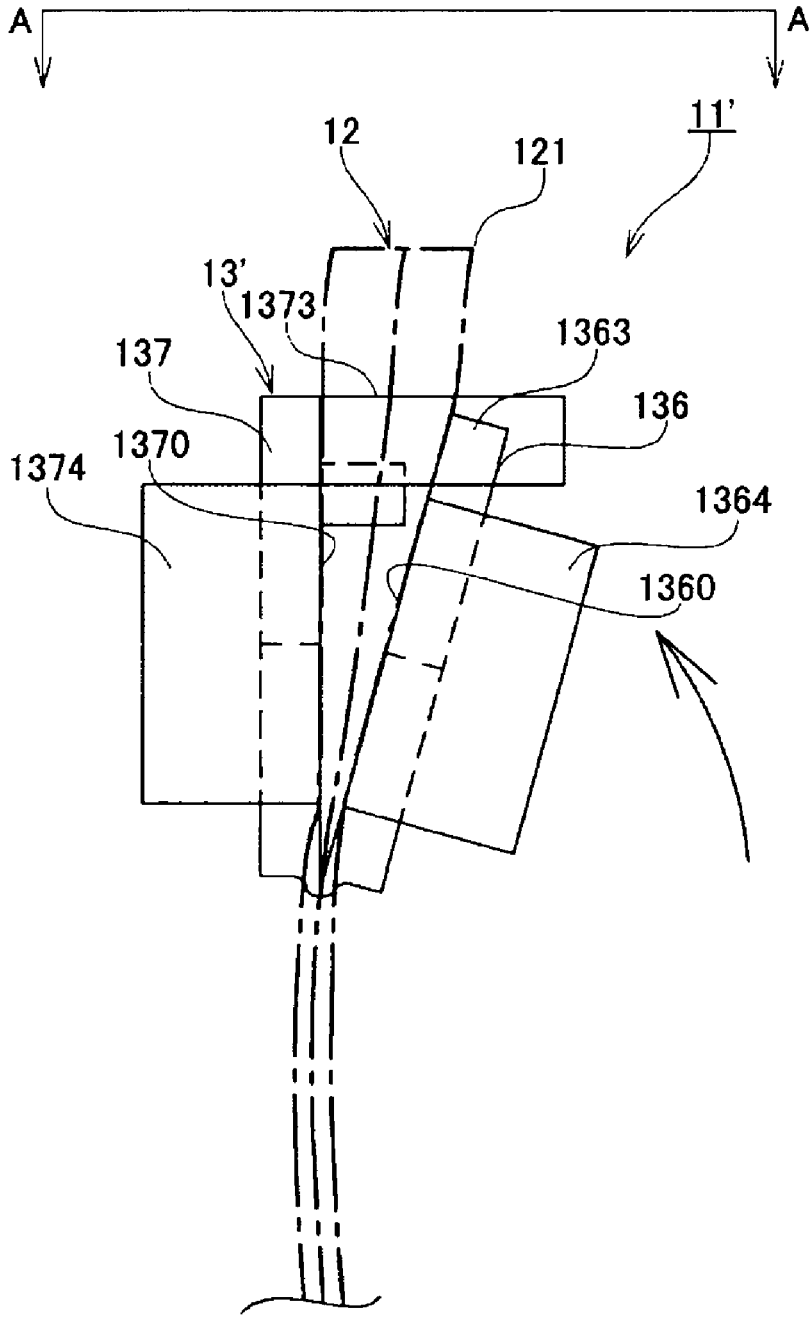
FIG. 15 is a diagram showing how an insertion orifice of a hair-holding member is widened by the open/close device in the hair holder according to the sixth embodiment.

As shown in FIG. 15, in the hair holder of the present embodiment, the open/close device 13' is fixed to the hair-holding member 12 by inserting one end of the hair-holding member 12 on the side of the insertion orifice 121 through the opening 1311' and then joining the one end to the flat face 1360 of the half 136 and the flat face 1370 of the half 137 of the open/close device 13'. Then, the halves 136 and 137 are brought into their opened state about the hinge sections 133' and thereby the insertion orifice 121 of the hair-holding member 12 is widened, and in this state, hair is inserted from the insertion orifice 121. Then, the halves 136 and 137 are closed together, so that the side faces 1363 of the half 136 engage with projecting ribs that constitute the projections-and-depressions 13731 of the columns 1373 on both sides. As a result, the projection 1372 fits into the slit 1362, and thus the hair bundle is held by the hair holder 12 without slipping or falling therefrom.

Figure 16A:
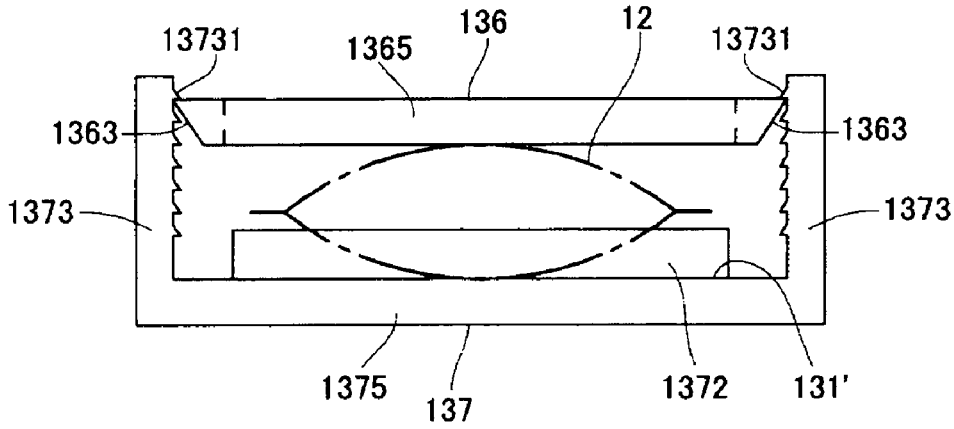
FIG. 16(*a*) and FIG. 16(*b*) are enlarged diagrams viewing FIG. 15 in the direction of arrow A-A thereof, wherein FIG. 16(*a*) is a diagram showing the insertion orifice of the hair-holding member in its widened state and FIG. 16(*b*) is a diagram showing the insertion orifice of the hair-holding member in its narrowed state.
Figure 16B:
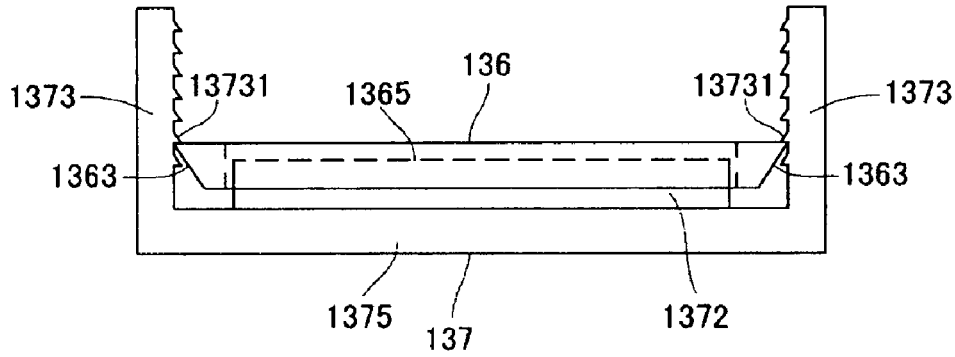

FIG. 16 is an enlarged diagram viewing FIG. 15 in the direction of arrow A-A thereof. Note that FIG. 16(*a*) does not show the operation pieces 1364 and 1374. Further, FIG. 16(*b*) shows neither the operation pieces 1364 and 1374 nor the hair-holding member 12.

As shown in FIG. 16(*a*), in the open/close device 13' of the present embodiment, the side edges 1363 engage with the projecting ribs forming the projections-and-depressions 13731 of the respective columns 1373, on the side of the tip ends 1365 and 1375 of the halves 136 and 137. In this way, the insert-and-attach opening 131' is formed by being surrounded by the tip ends 1365 and 1375 of the halves 136 and 137 and the columns 1373, and thus, the inner circumference of the insert-and-attach opening 131' forms a closed region. The expansion/contraction means 132' is provided in such a manner as to expand or contract the insert-and-attach opening 131' by making the hinge sections bend and thus changing the engagement position between the side edges 1363 of the half 136 and the columns 1373 to thereby move the halves 136 and 137 away from or toward one another.

As shown in FIG. 16(*a*), in the open/close device 13' of the present embodiment, a state in which the hinge sections are bent but the halves 136 and 137 are located away from one another is referred to as the state of "expansion" as used in "expansion/contraction". In other words, "expansion" refers to a state in which the insertion orifice of the hair-holding member 12 is widened. On the other hand, as shown in FIG. 16(*b*), a state in which the hinge sections are bent further so that the halves 136 and 137 are located close together is referred to as the state of "contraction" as used in "expansion/contraction". In other words, "contraction" refers to a state in which the insertion orifice of the hair-holding member is narrowed.

In the hair holder of the present embodiment as well, the insert-and-attach opening 131' of the open/close device 13' forms a closed region when the hair bundle is inserted into the insertion orifice of the hair-holding member, as with the hair holder 11 of the third embodiment. Therefore, the open/close device hardly takes in hair therearound, thus preventing hair creases and user pain due to hair jerking. Further, superior operability is achieved because expansion/contraction of the insert-and-attach opening 131' (opening/closing of the insertion orifice 121) is also done easily by bending the hinge sections 133' to move the halves 136 and 137 away from or toward one another.

Next, a seventh embodiment of a hair holder according to the present invention (the third aspect of the invention) is described. The following describes an open/close device which characterizes the hair holder of the seventh embodiment, and features in common with the open/close device of the third embodiment are omitted from explanation. Therefore, the explanation given in the third embodiment applies as appropriate to such features not particularly explained.

Figure 17A:
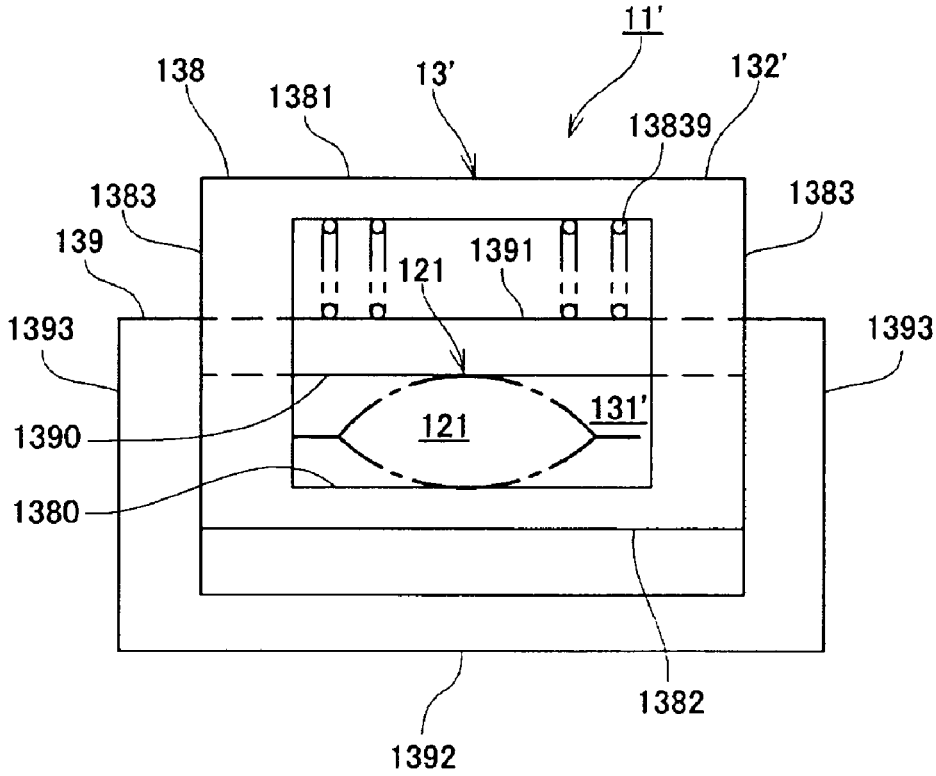
FIG. 17(*a*) and FIG. 17(*b*) are diagrams showing a structure of an open/close device in a hair holder according to a seventh embodiment of the present invention, wherein FIG. 17(*a*) is a plan view thereof and FIG. 17(*b*) is a side view thereof.
Figure 17B:
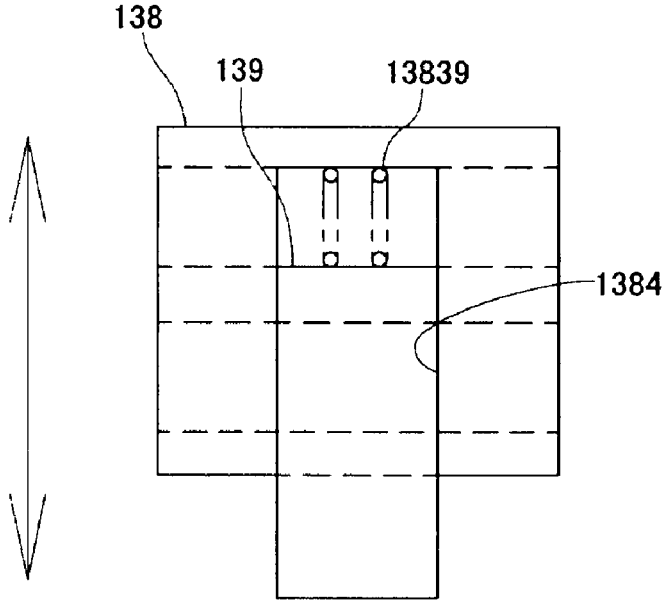

As shown in FIG. 17, an open/close device 13' of the present embodiment has two annular members 138 and 139 connected together via elastic members 13839. In this open/close device 13', an overlapping section between annular openings 1380 and 1390 of the respective annular members 138 and 139 forms an insert-and-attach opening 131'.

The annular member 138 is formed of an internally hollow member having a top plate 1381, a bottom plate 1382, and two side plates 1383 connecting the top and bottom plates. The inner surfaces of the plates form the annular opening 1380. The side plates 1383 each have a guide hole 1384 for guiding the annular member 139 when it moves up and down.

The annular member 139 is formed of an internally hollow member having a top plate 1391, a bottom plate 1392, and two side plates 1393 connecting the top and bottom plates. The inner surfaces of the plates form the annular opening 1390.

In this open/close device 13', the side plates 1393 connect, outside the side plates 1383, the top plate 1391 passed through the guide holes 1384 of the annular member 138 and the bottom plate 1392 located beneath the bottom plate 1382 of the annular member 138. The depth of a section of the top plate 1391 passed through the guide holes 1384 has approximately the same length as the width of the guide hole 1384. The inner surface of the top plate 1381 of the annular member 138 and the outer surface of the top plate 1391 of the annular member 139 are connected via the elastic members 13839. The present embodiment employs coil springs as the elastic members 13839.

In the hair holder 11' of the present embodiment, the open/close device 13' is fixed to the hair-holding member 12 by inserting one end of the hair-holding member 12 on the side of the insertion orifice 121 through the insert-and-attach opening 131' and then joining the one end to the inner surface of the bottom plate 1382 of the annular member 138 and the inner surface of the top plate 1391 of the annular member 139. In this open/close device 13', the expansion/contraction means 132' is provided in such a manner as to expand and contract the insert-and-attach opening 131' by relative movement between the annular members 138 and 139 that accompanies elastic deformation of the elastic members 13839.

Normally, the insert-and-attach opening 131' is slightly open so that the hair-holding member 12 can be inserted easily. In case the insert-and-attach opening 131' (the insertion orifice 121) is to be widened, the overlapping section between the annular openings 1380 and 1390 is widened by pressing the top plate 1381 of the annular member 138 and the bottom plate 1392 of the annular member 139 from above and below and causing the elastic members 13839 to contract (this is referred to as a state of "expansion" as used in "expansion/contraction"). Releasing the pressing force to release the contracted state of the elastic members 13839 will allow the insert-and-attach opening 131' (the insertion orifice 121) to narrow due to the elastic force of the springs (this is referred to as a state of "contraction" as used in "expansion/contraction").

In the hair holder of the present embodiment as well, the insert-and-attach opening 131' of the open/close device 13' forms a closed region when the hair bundle is inserted into the insertion orifice 121 of the hair-holding member 12, as with the hair holder 11 of the third embodiment. Therefore, the open/close device hardly takes in nor grasps hair therearound, thus preventing hair creases and user pain due to hair jerking. Further, superior operability is achieved because expansion/contraction of the insert-and-attach opening 131' (opening/closing of the insertion orifice 121) is also done easily by relative movement between the annular members 138 and 139, e.g., by extension/contraction of the elastic members 13839.

Next, another hair holder according to the present invention (a fourth aspect of the invention) is described based on a preferable embodiment thereof with reference to the drawings.

Figure 18:
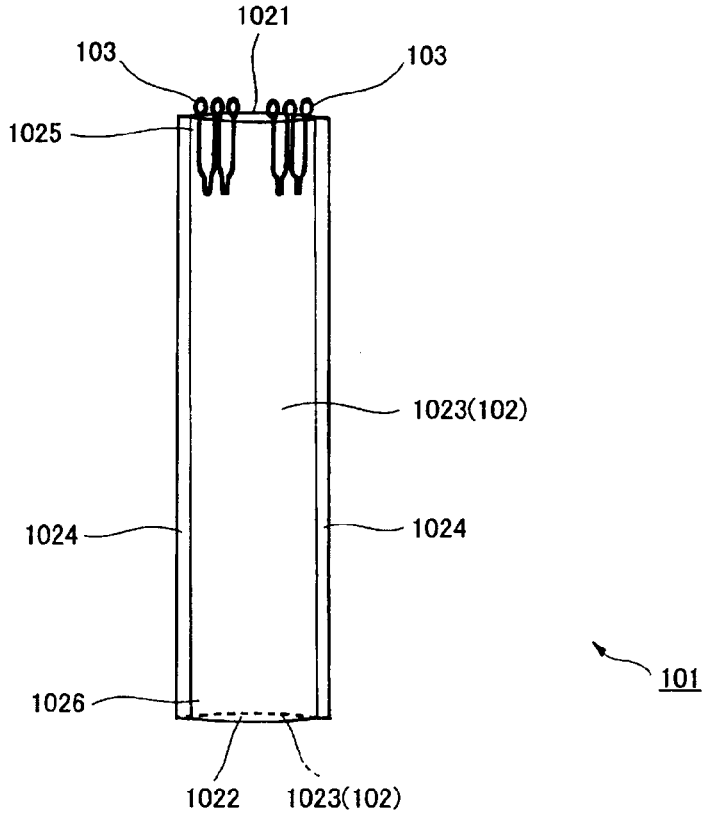
FIG. 18 is a perspective showing an eighth embodiment of a hair holder according to the present invention.
Figure 19:
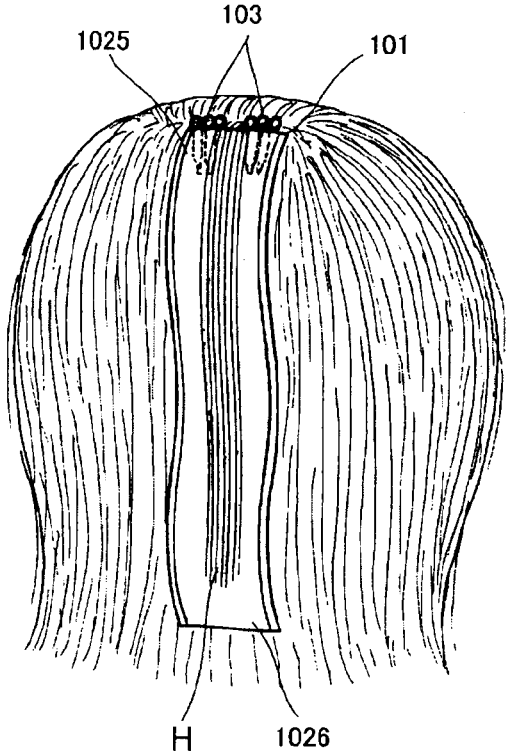
FIG. 19 is a schematic diagram showing a state in which the hair holder of FIG. 18 is attached to the head.
Figure 20:
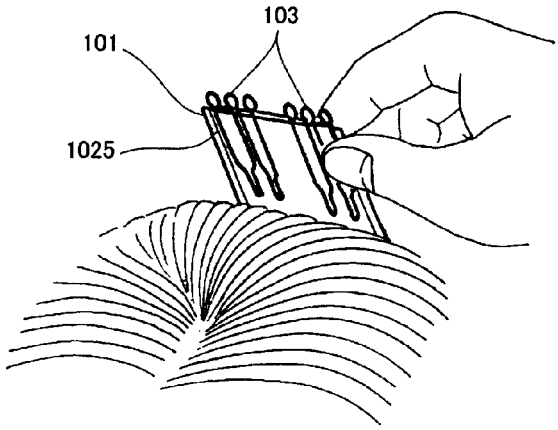
FIG. 20 is a schematic diagram showing how the hair holder of FIG. 18 is attached to the head.

As shown in FIGS. 18 to 20, a hair holder 101 according to an eighth embodiment is formed of a tube 102 and is used for dyeing a hair bundle H. The tube 102 is formed of a pair of sheets 1023 and 1023 and so designed that the hair bundle H can be inserted from an opening 1021 at one end toward an opening 1022 at the other end.

The hair holder 101 of the present embodiment also has fixing means for fixing the hair holder to a hair bundle other than the hair bundle H inserted from the one-end opening 1021.

The hair holder 101 of the present embodiment is described in detail below.

As shown in FIG. 18, the tube 102 is long in its longitudinal direction and is so structured that the hair bundle H can be inserted from the one-end opening 1021 toward the other-end opening 1022. The tube 102 is formed by joining together the pair of long rectangular sheets 1023 and 1023 at their lengthwise side ends 1024 and 1024. Each of the paired sheets 1023 and 1023 is soft and thus the tube 102 is flexible.

The length of the tube 102 is set appropriately depending on the length of the hair to be treated, and is preferably longer than the length of the hair to be treated. Each opening 1021, 1022 of the tube 102 has a generally elliptic shape and its size is set appropriately depending on the amount of the hair bundle to be inserted.

Generally, the tube 102 has a length of approximately 50 to 600 mm, and the size of each opening 1021, 1022 ranges approximately from 5 to 100 mm in major diameter and approximately from 2 to 40 mm in minor diameter. The openings 1021 and 1022 of the tube 102 are circular when the major diameter is equal to the minor diameter.

As shown in FIG. 19, the hair holder 101 is preferably used for applying dyeing treatment to the hair bundle H inside the tube 102 by inserting the hair bundle H into the tube 102 from the one-end opening 1021, supplying a dyeing agent, as a hair treating agent, to the tube 102, and spreading and applying the supplied dyeing agent to the hair bundle H by stroking the tube 102 from the side of the other-end opening 1022 toward the one-end opening 1021. In carrying out the dyeing treatment, it is preferable to position the side of an upper end 1025 having the one-end opening 1021 up and the side of a lower end 1026 having the other-end opening 1022 down, with respect to the length direction of the tube 102.

The pair of sheets 1023 and 1023 is made of a material impermeable to dyeing agents, and therefore, no dyeing agent leaks out from the side surfaces of the tube 102. This prevents hair other than the hair bundle inserted in the hair holder 101 from being dyed. Accordingly, the dyeing treatment using the hair holder 101 of the present embodiment is particularly effective in partially dyeing the hair on one's head.

The dyeing agent exists in the hair holder 101 in a relatively sealed state. Therefore, in cases where the dyeing agent includes volatile components, such components are prevented from volatilizing during dyeing. Accordingly, the hair holder is advantageous in that the dyeing treatment can be performed efficiently.

Examples of materials preferably used for forming the pair of sheets 1023 and 1023 include resin films made, for example, of polyethylene, polypropylene, polyethylene terephthalate, nylon, polystyrene, or polyvinyl chloride, or a composite thereof.

As shown in FIGS. 18 and 19, the fixing means in the hair holder 101 of the present embodiment employs a pair of pins 103 and 103. The pair of pins 103 and 103, serving as the fixing means, is provided in the vicinity of the one-end opening 1021.

The pair of pins 103 and 103 is joined to an edge on the side of the upper end 1025 of either one of the paired sheets 1023 and 1023 forming the tube 102.

As shown in FIG. 18, the paired pins 103 and 103 are joined at the upper end 1025 of the tube 102 using known joining means while being spaced from one another in the width direction of the tube 102.

Each paired pin 103, 103 is a section for detachably fixing the hair holder 101 to a hair bundle other than the hair bundle H inserted from the one-end opening 1021.

The pin tip of each paired pin 103, 103 to be inserted into the hair bundle is oriented toward the lower end 1026 of the tube 102. Each paired pin 103, 103 is structured by connecting two pin pieces together. This structure allows engagement with a relatively large amount of hair on one's head.

In terms of attaching the hair holder 101 onto the head securely and stably, it is preferable that the section of each paired pin 103, 103 to be inserted into the hair bundle is 10 to 100 mm long, and more preferably 20 to 50 mm long.

When attaching the hair holder 101 of the present embodiment to the hair bundle other than the hair bundle H inserted from the one-end opening 1021, it is preferable to attach the holder to the head with the sheet having the pair of pins 103 and 103 facing the head, as shown in FIG. 20.

The hair holder 101 of the present embodiment has the pair of pins 103 and 103 serving as the fixing means. Accordingly, a large amount of hair is employed to attach the hair holder 101 to the head, thus lessening the feeling that the scalp is being pulled downward and also achieving stable attachment of the hair holder 101 to the head.

Further, from the above-described viewpoint, it is preferable to fix the hair holder 101 also to the hair bundle H inserted from the one-end opening 1021, for example, using a clip, when attaching the hair holder 101 of the present embodiment to the head, in addition to engaging the pair of pins 103 and 103 with the hair bundle other than the hair bundle H inserted from the one-end opening 1021.

Materials for making various conventionally-known pins having prescribed elasticity and rigidity can be used for forming the pair of pins 103 and 103; preferable materials are those that do not cause chemical reactions, in particular, corrosion, discoloration, etc. to dyeing agents. Examples of such materials preferably include polypropylene, polyacetal, iron, and aluminum. Even materials that cause chemical reactions, such as corrosion and discoloration, to dyeing agents can preferably be used if their surfaces are covered, for example, with a metal or a resin chemically inert to dyeing agents.

The hair holder 101 of the present embodiment is described in further detail. In order to prevent dyeing agents supplied inside the tube 102 from flowing out from the other-end opening 1022, the lower end 1026 of the tube 102 preferably has an openable/closable sealing means.

An example of the sealing means includes a zipper. Providing a zipper on the lower end 1026 allows opening/closing of the other-end opening 1022. Other than a zipper, it is also possible to use, for example, a hook-and-loop fastener, an adhesive tape, or a self-adhesive tape (for example, "Fushigi Tape" (trade name) available from Nirei Industry Co., Ltd.) as the sealing means.

Further, the above-described sealing means may preferably be made by joining, to the lower end 1026, a member that has plasticity and can maintain its folded state, such as an aluminum foil. For example, a long rectangular aluminum foil strip having the same width as the tube 102 is joined thereto in such a manner that the edge of the foil strip is aligned with the edge of the tube on the side of the lower end 1026. The section of the lower end 1026 having the aluminum foil strip is folded upward once or several times to thereby seal the lower end of the tube 102.

In the hair holder 101 of the present embodiment, it is also preferable to use a hair inserter upon dyeing treatment for inserting a hair bundle H from the one-end opening 1021 into the tube 102. A preferable hair inserter is used in a state inserted inside the hair holder 101 and has a latch-hook at one end for hooking a hair bundle H and a grip at the other end, wherein the latch-hook extends outward from the one-end opening 1021 and the grip extends outward from the other-end opening 1022. The specifications of JP2003-93133 A and US2004/216759 A1 mentioned above disclose examples of such a hair inserter.

The following describes a example of dyeing treatment using the above-described hair holder 101 and the hair inserter. In terms of dyeing the entire hair bundle H, it is preferable that the length of the tube 102 of the hair holder 101 used for dyeing is longer than the length of the hair bundle H.

First, the hair holder 101 is prepared with the latch-hook of the hair inserter extending outward from the one-end opening 1021, the grip extending outward from the other-end opening 1022, and the hair inserter inserted inside the tube 102.

Next, the hair bundle H is hooked into the hair inserter's latch-hook. In doing so, it is preferable to hook, into the latch-hook, a portion of the hair bundle H close to the scalp. Then, the grip is pulled with the latch-hook engaged to the hair bundle H to insert the hair bundle H into the tube 102. The hair bundle H is brought into a generally linear, straightened state inside the tube 102.

Then, a dyeing agent is supplied from the other-end opening 1022 of the tube 102 and is spread and applied onto the hair bundle H by stroking the tube 102 with the fingers in a direction from the lower end 1026 toward the upper end 1025.

Also, it is preferable to seal the lower end 1026 in cases where the tube 102 has the above-described sealing means.

After repeating the same operation using a plurality of hair holders 101 if desired, the hair holders and the hair held by the holders are left as they are for a prescribed amount of time. After the prescribed time, the hair bundle H is removed from the hair holder 1. Preferably, the hair is then rinsed and is also shampooed and blow-dried.

Next, hair holders 101 according to the ninth through eleventh embodiments are described with reference to FIGS. 21 to 24. The explanation given in detail with respect to the eighth embodiment applies as appropriate to features that are not particularly described in the ninth through eleventh embodiments. Further, in FIGS. 21 to 24, like components are accompanied with the same symbols as those in FIGS. 18 to 20.

In a hair holder 101 according to a preferred ninth embodiment of the present invention, the fixing means is an adhesive section 104. The adhesive section 104 is formed by applying a water-soluble adhesive onto the tube 102, and is provided in the vicinity of the one-end opening 1021.

Figure 21:
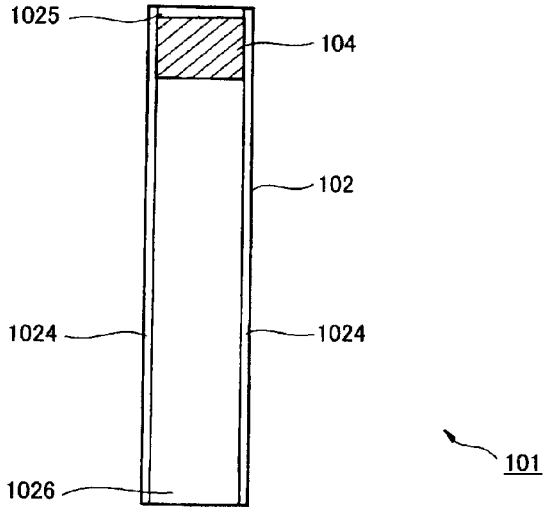
FIG. 21 is a plan view showing a ninth embodiment of a hair holder according to the present invention.
Figure 22:
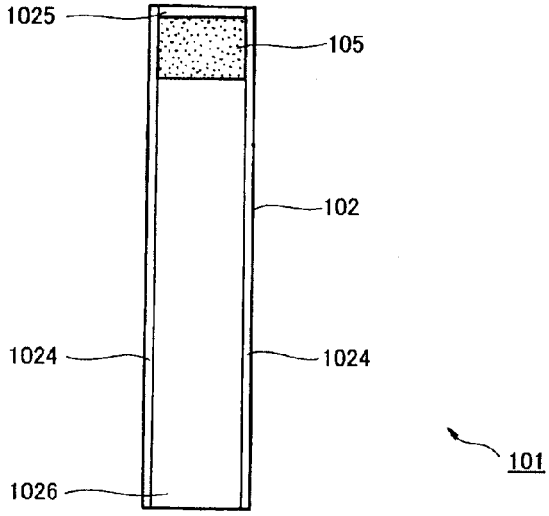
FIG. 22 is a plan view showing a tenth embodiment of a hair holder according to the present invention.

As shown in FIG. 21, the adhesive section 104 is rectangular in shape, and is formed on the outer surface at the upper end 1025 of either one of the paired sheets 1023 and 1023 forming the tube 102.

The adhesive section 104 is a section for detachably fixing the hair holder 101 to a hair bundle other than the hair bundle H inserted from the one-end opening 1021. Preferably, a release paper is placed on the adhesive section 104 for protection until the hair holder 101 of the present embodiment is to be used.

The hair holder 101 of the present embodiment is described in further detail.

The adhesive section 104 is formed across both ends, in the width direction, of the tube 102. From the viewpoint of attaching the hair holder 101 securely and stably onto the head with the adhesive section 104, it is preferable that the length of the adhesive section 104 in the length direction of the tube 102 is 10 to 100 mm, and more preferably 20 to 50 mm.

Also from the same viewpoint, it is preferable to provide the adhesive section 104 within a range of from 5 to 200 mm, and more preferably from 10 to 50 mm, from the edge of the upper end 1025.

When fixing the hair holder 101 of the present embodiment to the hair bundle other than the hair bundle H inserted from the one-end opening 1021, it is preferable to attach the holder to the head with the sheet having the adhesive section 104 facing the head.

In some cases, the adhesive forming the adhesive section 104 may adhere to the hair when the hair holder 101 is removed from the head after the dyeing treatment. By employing a water-soluble adhesive, it is possible to rinse the adhesive off from the hair easily by shampooing the hair.

Substances that are safe even when in contact with the hair and the scalp are preferable for the water-soluble adhesive forming the adhesive section 104. Preferable examples of such adhesives include anionic binders having at least one carboxyl group, polyvinyl alcohol, starch or derivatives thereof, sodium alginate, tragacanth gum, guar gum, xanthan gum, arabic gum, carrageenan, galactomannan, gelatin, casein, albumin, pullulan, polyethylene oxide, viscose, polyvinylethyl ether, sodium polyacrylate, sodium polymethacrylate, polyacrylamide, hydroxylated derivatives of polyacrylic acid, and polyvinylpyrrolidone/vinylpyrrolidone vinyl acetate copolymer. Examples of anionic binders include polysaccharide derivatives, synthetic polymers, and natural products. Examples of polysaccharide derivatives include carboxymethyl cellulose (CMC) or salts thereof, carboxyethyl cellulose or salts thereof, and carboxymethylated starch or salts thereof, and alkali metal salts of carboxymethyl cellulose are more preferred of them. Examples of synthetic polymers include salts of polymers or copolymers of unsaturated carboxylic acids, and salts of copolymers of unsaturated carboxylic acids and monomers copolymerizable therewith. Examples of unsaturated carboxylic acids include acrylic acid, methacrylic acid, itaconic acid, crotonic acid, maleic anhydride, maleic acid, and fumaric acid. Examples of monomers copolymerizable with these acids include esters of these unsaturated carboxylic acids, vinyl acetate, ethylene, acrylamide, and vinyl ether. Examples of natural products include xanthan gum, gellan gum, tragacanth gum, and pectin.

Examples of water-insoluble adhesives forming the adhesive section 104 include adhesive gels. There are, for example, silicone-based and urethane-based gels, and these gels can conform and adhere to the projections and depressions on the hair-bundle surface. Such adhesive gels do not remain on the hair bundle after removal of the adhesive section 104.

In terms of attaching the hair holder 101 securely and stably onto the head with the adhesive section 104, it is preferable that the coating basis weight of the adhesive in the adhesive section 104 with respect to the tube 102 is 5 to 200 $g/m^2$, and more preferably 10 to 50 $g/m^2$.

The hair holder 101 according to the present embodiment described above achieves the same effects as those of the previously-described embodiments.

Now, in a hair holder 101 according to a preferred tenth embodiment of the present invention, the fixing means is a hook member 105 of a hook-and-loop fastener. The hook member 105 is provided in the vicinity of the one-end opening 1021. As shown in FIG. 5, the hook member 105 is rectangular in shape, and is joined to the outer surface at the upper end 1025 of either one of the paired sheets 1023 and 1023 forming the tube 102.

The hook member 105 is a section for detachably fixing the hair holder 101 to a hair bundle other than the hair bundle H inserted from the one-end opening 1021.

The hair holder 101 of the present embodiment is described in further detail.

When attaching the hair holder 101 to the hair bundle other than the hair bundle H inserted from the one-end opening 1021, it is preferable to attach the holder to the head with the sheet having the hook member 105 facing the head.

In attaching the hair holder 101 to the head, the hook member 105 is moved vertically and sideways with respect to the hair bundle while being pressed against the hair bundle which serves as a loop member of the hook-and-loop fastener. In this way, the hook member 105 engages with the hair bundle, and the hair holder 101 is detachably fixed to the head.

The hook member 105 is joined to the tube across both ends, in the width direction, of the tube 102. From the viewpoint of attaching the hair holder 101 securely and stably onto the head with the hook member 105, it is preferable that the length of the hook member 105 in the length direction of the tube 102 is 5 to 200 mm, and more preferably 20 to 100 mm.

The hair holder 101 according to the present embodiment described above achieves the same effects as those of the previously-described embodiments.

Figure 23:
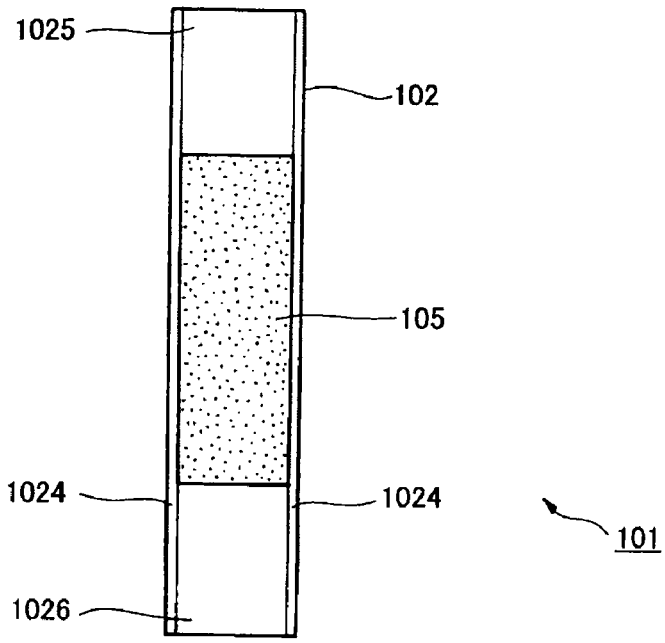
FIG. 23 is a plan view showing an eleventh embodiment of a hair holder according to the present invention.

Now, in a hair holder 101 according to a preferred eleventh embodiment of the present invention, a hook member 105 of a hook-and-loop fastener serving as the fixing means is provided in a central section of the tube 102 in the length direction thereof, as shown in FIG. 23. The "central section of the tube 102 in the length direction thereof" is a section except for both ends in the length direction.

The hook member 105 is long and rectangular, and its length direction matches the length direction of the tube 102.

Figure 24:
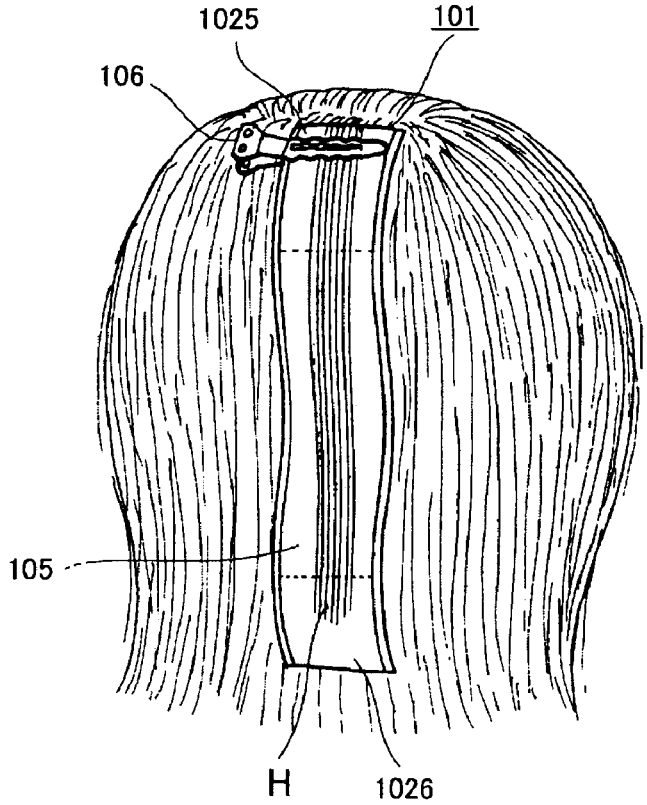
FIG. 24 is a schematic diagram showing a state in which the hair holder of FIG. 6 is attached to the head.

As shown in FIG. 24, it is preferable to detachably fix the upper end 1025 of the hair holder 101 of the present embodiment to the hair bundle H inserted from the one-end opening 1021 with, for example, a clip 106. The hair holder 101 is attached to the head more securely and stably.

The hair holders according to various aspects of the invention (the first through fourth aspects of the invention) are not limited to the embodiments described above, and can be modified as appropriate as long as they do not depart from the spirit and scope of the invention.

For example, the hair holder according to the first aspect of the invention may be constituted only of the hair holder itself or may include both the hair holder and the clip-type fixing member.

Further, the integration means in the first aspect of the invention may be achieved by providing a hook member or a loop member of a mechanical hook-and-loop fastener on the outer surface of the tube 2 and providing a loop member and a hook member of the mechanical hook-and-loop fastener on the pinchers of the clip-type fixing member 3. The integration means in the first aspect of the invention may also be achieved by providing an adhesive or a double-faced adhesive tape on the outer surface of the tube 2, covering it with a release paper etc., and removing the release paper upon use to expose the adhesive face or the adhesive.

Further, the integration means in the first aspect of the invention and the fixing section in the second aspect of the invention do not have to be integrated with or fixed to only the section S2 close to the side end 24*b*, which is located on the pinchers' tip-end side of the clip-type fixing member 3, within the in-between of the tube's side ends 24*a* and 24*b*. That is, the section S1 close to the side end 24*a* located on the side of the pivot 33 of the clip-type fixing member 3 may be integrated with or fixed to the pincher.

The passage 4 serving as the integration means in the first aspect of the invention does not have to be formed by fixing the strip 41 to the sheet 23 forming the tube. Instead, as shown in FIG. 7, each sheet 23 forming the tube may have a pair of holes 42 and 43, and an area between the holes 42 and 43 may serve as the passage 4 through which the pincher 31 or 32 can pass. In this case, attaching a member having high frictional resistance, such as a nonwoven fabric, on the tube's inner surface around the passage holes will allow the pincher having passed through the passage holes to be prevented from falling out from the passage.

Further, instead of forming the passage 4 by fixing the strip to the tube's outer surface, the passage may be formed by fixing, for example, a sheet material having any shape such as a square. It is also possible to prepare an originally-cylindrical component and fix it on the tube 2 with the axial direction of the component along the width direction of the tube.

Moreover, instead of integrating both pinchers 31 and 32 of the clip-type fixing member 3 at the above-described preferable positions within the in-between of the tube's side ends 24*a* and 24*b*, the hair holder may be structured so that only one of the pinchers is integrated at the above-described preferable position. The same applies to the fixing section 4A of the second aspect of the invention.

Permanent straightening is also preferably carried out using the hair holder of the present invention. For example, in performing the permanent-straightening treatment, it is necessary to apply a permanent treatment solution to the hair as the hair treating agent. In this case, it is preferable to use a material permeable to the permanent treatment solution as one or both of the pair of sheets 23 and 23 forming the tube 2. A hair bundle H to be subjected to the permanent treatment is held in the hair holder 1, and then the permanent treatment solution is supplied from the outside of the hair holder 1 and applied to the hair bundle by permeating the sheet(s). This allows the permanent treatment to be done efficiently.

For example, in the fifth embodiment, a coil spring is employed as the elastic member. The elastic member, however, is not particularly limited thereto, as long as it allows the annular members to move relative to one another. For example, it is possible to employ elastic members of other forms, such as rubber columns and rubber tubes.

Further, in the hair holder of the fourth aspect of the invention, the fixing means may be a clip, for example.

Moreover, permanent straightening is also preferably carried out using the hair holder of the fourth aspect of the invention. For example, in performing the permanent-straightening treatment, it is necessary to apply a permanent treatment solution to the hair as the hair treating agent. In this case, it is preferable to use a material permeable to the permanent treatment solution as one of the paired sheets 1023 and 1023, which form the tube 102, not having the fixing means. A hair bundle H to be subjected to the permanent treatment is held in the hair holder 101, and then the permanent treatment solution is supplied from the outside of the hair holder 101 and applied to the hair bundle by permeating the sheet. This allows the permanent treatment to be done efficiently.

The features of a foregoing embodiment omitted from explanation and elements provided only in one embodiment are applicable to the other embodiments as appropriate, and the elements in each embodiment are interchangeable among the embodiments as appropriate.

For example, the tube in the first aspect of the invention may be employed as the hair-holding member of the third aspect of the invention, and combining the tube with the hair-holding-member open/close device in the third aspect of the invention may achieve a hair holder. More specifically, a hair holder may be achieved, for example, by combining the tube 2 in the hair holder 1 of the first embodiment shown in FIGS. 1 to 3 with the hair-holding-member open/close device 13' in the hair holder of the fourth embodiment shown in FIG. 11. In this case, it is preferable to integrate the long and short pieces 134' and 135' of the open/close device 13' with a portion of the tube 2 by arranging the passages 4 and 4 of the tube 2 in such a manner that the long and short pieces can pass through the passages.

EXAMPLES

A hair holder having the configuration shown in FIGS. 1 to 3 was prepared. Passages 4 were provided respectively on the opposing first and second sides F and R of the tube 2, with the width of the passage (equal to the width of the strip for forming the passage; referred to as "passage strip" in Table 1) being set as shown in Table 1. The strip for forming the passage was arranged so that the center of the width of the strip is positioned in the center between the one side edge 24*a* and the other side edge 24*b* of the tube.

A clip-type fixing member having the configuration shown in FIG. 4 was mounted to each hair holder prepared. The opening 21 was opened up to measure the maximum opening amount (see FIG. 4(*b*)). Also, using a haired head model, the ease of inserting hair into each hair holder was evaluated. The evaluation criteria and the results are shown in Table 1.

TABLE 1

Width W of Tube between Both Side Ends (Bag Width) = 50 mm

| | Examples | | | | | Comparative Example |
|---|---|---|---|---|---|---|
| Width of Passage Strip (Ratio to Bag Width) | 10 mm (20%) | 20 mm (40%) | 30 mm (60%) | 40 mm (80%) | 45 mm (90%) | 50 mm (100%) |
| Opening Amount L | 40 mm | 30 mm | 20 mm | 10 mm | 3 mm | 1 mm or less |
| Hair Insertion Ease | B | A | A | B | C | D |

*A: Extremely easy to insert hair into holder.
*B: Possible to insert hair into holder.
*C: Possible to insert hair into holder, but with some resistance upon insertion.
*D: Not possible to insert hair into holder.

INDUSTRIAL APPLICABILITY

The hair holder of the present invention can achieve easy and quick insertion of a hair bundle into a tube and fixing of the tube to the hair bundle.

Further, the hair holder of the present invention achieves comfortable attachment and stable fixing to the head.

Moreover, the hair-holding-member open/close device and the hair holder of the present invention achieve superior operability and prevent hair creases and user pain due to hair jerking, since hair around the device/holder is hardly taken in nor grasped thereby.

The invention claimed is:

1. A hair holder, comprising:

a tube and a clip-type fixing member, the tube being formed of a sheet in such a design as to allow a hair bundle to be inserted from a one-end opening at one end of the tube toward the other end thereof, the tube having integration means in a vicinity of the one-end opening, the integration means allowing a clip-type fixing member having a pair of pinchers to be integrated with the tube, the one-end opening being openable and closable by operating the clip-type fixing member having been integrated with the tube, wherein the integration means includes a passage through which each of the pinchers of the clip-type fixing member can pass, the passage provided on an exterior of the tube, the passage provided to each of a first side of the tube and an opposing second side thereof, and the passage of the first side and the passage of the second side are formed at different positions in a width direction of the tube, the clip-type fixing member includes a projection extending radially from each of the pinchers to prevent each of the pinchers passed through the passage from falling out therefrom, and the projection is a hook which engages an end of the passage when each of the pinchers is fully inserted through the passage.

2. The hair holder according to claim 1, wherein at least one of the pinchers is integrated with a section within an area between a one side end and the other side end of the tube but excluding a section close to at least either one of the side ends.

3. The hair holder according to claim 2, wherein each of the pair of pinchers is integrated with a section occupying 80% or less of a distance from the one side end to the other side end of the tube.

4. A hair holder, comprising:

a clip-type fixing member; and a tube, the tube being formed of a sheet in such a design as to allow a hair bundle to be inserted from a one-end opening at one end of the tube toward the other end thereof, the tube having integration means in a vicinity of the one-end opening, the integration means allowing the clip-type fixing member having a pair of pinchers to be integrated with the tube, the one-end opening being openable and closable by operating the clip-type fixing member having been integrated with the tube, wherein the integration means is a passage through which each of the pinchers of the clip-type fixing member can pass, the passage provided on an exterior of the tube, and the passage provided to each of the first side of the tube and the opposing second side thereof, one of the pinchers and the other of the pinchers of the clip-type fixing member have different lengths, the clip-type fixing member includes a projection extending radially from each of the pinchers to prevent each of the pinchers passed through the passage from falling out therefrom, and the projection is a hook which engages an end of the passage when each of the pinchers is fully inserted through the passage.

* * * * *